US011840863B2

(12) United States Patent
Salimov

(10) Patent No.: US 11,840,863 B2
(45) Date of Patent: Dec. 12, 2023

(54) KEY HAVING A CATCH AND A REPLACEABLE BLADE, LOCK, AND OPERATING METHOD THEREOF (VARIANTS)

(71) Applicant: Ildar Ibragimovich Salimov, Moscow (RU)

(72) Inventor: Ildar Ibragimovich Salimov, Moscow (RU)

( * ) Notice: Subject to any disclaimer, the term of this patent is extended or adjusted under 35 U.S.C. 154(b) by 430 days.

(21) Appl. No.: 17/049,174

(22) PCT Filed: Apr. 15, 2019

(86) PCT No.: PCT/RU2019/000247
§ 371 (c)(1),
(2) Date: Oct. 20, 2020

(87) PCT Pub. No.: WO2019/212383
PCT Pub. Date: Nov. 7, 2019

(65) Prior Publication Data

US 2021/0238885 A1 Aug. 5, 2021

(30) Foreign Application Priority Data

May 3, 2018 (RU) ..... 2018116428

(51) Int. Cl.
*E05B 19/18* (2006.01)
*E05B 9/04* (2006.01)
(Continued)

(52) U.S. Cl.
CPC ..... *E05B 19/18* (2013.01); *E05B 9/04* (2013.01); *E05B 11/00* (2013.01); *E05B 15/06* (2013.01);
(Continued)

(58) Field of Classification Search
CPC . E05B 9/04; E05B 9/042; E05B 11/00; E05B 11/06; E05B 13/004; E05B 15/06;
(Continued)

(56) References Cited

U.S. PATENT DOCUMENTS 2,047,331 A * 7/1936 Pollak ..... A45C 11/324 70/456 R
2,356,891 A * 8/1944 Seiffert ..... E05B 19/18 70/411
(Continued)

*Primary Examiner* — Christopher J Boswell
(74) *Attorney, Agent, or Firm* — Nadya Reingand

(57) ABSTRACT

Proposed is a group of inventions relating to locking mechanisms, containing keys which can be separated into parts and which have catches and a plurality of replaceable blades which fit a plurality of locks, the replaceable blades of the keys of all of said locks attach to the catches of one key part having a bow, thus reducing the weight and overall size of a bunch of keys, allowing a person to carry only one key part having a bow and a plurality of key blades pertaining to different locks, reducing the weight and size of a bunch of keys, and a lock having corresponding mating mechanisms, increasing the security of the locking mechanism. The drawing shows the position of two catches on a key shank, using the example of a key to a pin-tumbler mechanism.

10 Claims, 4 Drawing Sheets

(51) Int. Cl.

| | |
|---|---|
| ***E05B 15/06*** | (2006.01) |
| ***E05B 35/00*** | (2006.01) |
| ***E05B 35/14*** | (2006.01) |
| ***E05B 35/08*** | (2006.01) |
| ***E05B 11/00*** | (2006.01) |

(52) U.S. Cl.
CPC ..... *E05B 35/003* (2013.01); *E05B 35/083* (2013.01); *E05B 35/14* (2013.01)

(58) Field of Classification Search
CPC ..... E05B 15/08; E05B 15/14; E05B 63/0056; E05B 17/0004; E05B 17/12; E05B 17/14; E05B 17/142; E05B 17/16; E05B 17/18; E05B 19/00; E05B 19/0017; E05B 19/0082; E05B 19/04; E05B 19/043; E05B 19/046; E05B 19/14; E05B 19/18; E05B 35/003; E05B 35/083; E05B 35/086; E05B 35/14
See application file for complete search history.

(56) References Cited

U.S. PATENT DOCUMENTS 3,243,979 A * 4/1966 Silvern ..... E05B 19/18 70/411
3,261,189 A * 7/1966 Ellison ..... E05B 9/086 70/381
3,349,589 A * 10/1967 Fricke ..... E05B 19/04 70/456 R
3,668,909 A * 6/1972 Roberts ..... E05B 19/18 70/411
3,729,965 A * 5/1973 Gartner ..... E05B 19/04 70/408
3,808,853 A * 5/1974 Helenurm ..... E05B 19/18 70/411
3,895,508 A * 7/1975 Crasnianski ..... E05B 19/04 70/408
4,055,880 A * 11/1977 Moessner ..... E05B 19/04 29/267
4,103,525 A * 8/1978 Kamiya ..... E05B 19/18 70/411
4,287,735 A * 9/1981 Brunken ..... E05B 19/18 70/411
4,545,226 A * 10/1985 Urrestarazu-Borda ..... E05B 19/18 70/411
4,662,200 A * 5/1987 Borda ..... E05B 19/18 70/411
5,131,247 A * 7/1992 Hsu ..... E05B 19/18 70/389
5,355,702 A * 10/1994 Escribens ..... E05B 19/18 70/411
5,893,282 A * 4/1999 Runge ..... E05B 63/0056 70/448
5,943,889 A * 8/1999 Chiu ..... E05B 19/043 70/459
6,758,073 B2 * 7/2004 Yu ..... E05B 27/001 70/423
7,526,935 B2 * 5/2009 Huang ..... E05B 31/00 70/495
8,225,696 B2 * 7/2012 Downes ..... E05B 19/046 29/402.06
8,881,567 B2 * 11/2014 Chong ..... E05B 29/004 29/804
9,316,023 B2 * 4/2016 Lundberg ..... E05B 27/0017
10,066,418 B2 * 9/2018 Zhang ..... E05B 19/18
10,428,556 B2 * 10/2019 Bowley ..... E05B 27/001
2008/0314106 A1 * 12/2008 Mathachan ..... E05B 27/005 70/493

* cited by examiner

KEY HAVING A CATCH AND A REPLACEABLE BLADE, LOCK, AND OPERATING METHOD THEREOF (VARIANTS)

TECHNICAL FIELD

The group of inventions relates to the field of construction engineering and, in particular, to the manufacture of ironmongery products, such as locks for safes, windows, doors, cabinets, caskets, and the like. The group of inventions can reduce the weight and dimensions of a portable bunch of keys, increase lockpicking resistance, make it difficult to provide unauthorized lock opening, and reduce the likelihood of unauthorized lock opening for a given time interval. The group of inventions relates to the following class: IPC E05B 19/18 (keys adjustable before use).

BACKGROUND

A lock 200 known from the prior art is a device for locking doors, windows, and similar access control devices. The lock 200 has at least two static states, i.e. "open" when a bolt 204 is retracted in a lock body 205, and "closed" when the bolt 204 projects from the lock body 205. The lock 200 has at least one dynamic state referred to as a working stroke at which the lock transfers from one of the static states into another of the static states. The working stroke of the lock 200 is possible only when a suitable key 100 is inserted in the lock 200. It is possible to open the lock 200 without authorization by means of burglary, lockpicks, curls, bump keys, and the like. The time required to open the lock 200 without authorization defines its resistance.

The resistance of the lock 200 to such unauthorized opening defines the quality of the lock 200 and its customer value.

Many embodiments of the lock 200 are known from the prior art. The most complicated embodiments use up-to-date electronic devices, identifies an owner of the lock 200 based on a fingerprint, iris pattern, voice. However, all of them need electrical power and are not easy to use.

The most reliable locks are mechanical locks 200 in which the energy caused by moving the bolt 204 from the state "open" to the state "closed" and vice versa comes from a human hand opening the lock 200. The group of inventions relates to the mechanical locks 200. However, it can be also used in locks 200 comprising electronic and/or electrical, and/or other devices that can serve as an energy source and can be used to increase lockpicking resistance and a number of secret combinations of the lock 200.

The most common types of the locks 200 are lever tumbler locks, pin tumbler locks and disc tumbler locks. Devices based on these types of the locks 200 are well known from the prior art. By analyzing components of all known locks 200, one can find the following main assemblies constituting a locking device 300: the key 100 and the lock 200. Every key 100 cannot open the lock 200, and only a suitable key 100 can do that. The suitable key 100 is such a key 100 whose key secrets 103 are configured to activate a secret mechanism 202 of the lock when they interact with the secret mechanism 202 of the lock. As a result of the activation, the secret mechanism 202 of the lock gains or loses the ability to move depending on the design of the lock 200, while a bolt drive 203 gains the ability to move and/or gains the ability to transfer this movement to the bolt 204. Only the key 100 and the lock 200 that fit together can constitute the locking device 300.

The key 100 known from the prior art comprises, inter alia, the following essential elements:

- a bow 101;
- a shank 102 combining the key secret 103 and the bow 101 into a single device, i.e. the key 100;
- the key secret 103;
- a key grab 104 used to reduce the dimensions of the key 100, thereby improving the storageability and portability of the key 100;
- a key cover 105 increasing a contact area between a human hand and the key 100;
- a key case 106 that encompasses a part of the key 100 when transporting and storing the key 100.

The lock 200 known from the prior art comprises, inter alia, the following essential elements:

- a keyhole 201 (for example, a keyhole in a lever tumbler lock, a keyhole in a disc tumbler lock, or a shaped slot in a cylinder mechanism of a pin tumbler lock), which is used to deliver the key secret 103 to the secret mechanism 202 of the lock 202;
- the secret mechanism 202 of the lock (for example, levers in a lever tumbler lock, discs in a disc tumbler lock or sets of pins (delays) in a pin tumbler lock), which is activated (gains the ability to move or loses the ability to move) after the suitable key secret 103 is delivered through the keyhole 201 to the secret mechanism 202;
- the bolt drive 203, i.e. a part of the lock which is set in motion by any element of the key 100 or any other part of the lock, receives movement from any element of the key 100, and which moves the bolt 204 after the secret mechanism 202 of the lock is activated by the key secret 103;
- the bolt 204 which, when closed, is usually pulled out of the lock body 205 under the action of the bolt drive 203 and prevents a door from opening, and when opened, it is retracted in the lock body 205 and does not prevent the door from opening;
- the lock body 205 comprising the above-indicated elements of the lock, thereby providing the necessary mutual arrangement of the elements of the locking device 300.

Let us now consider the purpose of the main elements of the locking device 300 in more detail.

The key 100 is stored separately from the lock 200, usually in a pocket or purse of a person and is used when it is required to provide the working stroke of the lock 200, i.e. to change the static state of the lock 200 from "open" to "closed", and/or vice versa. The bow 101 is part of the key which is not inserted in the lock body 205 and is not inserted in the keyhole 201. The bow 101 remains accessible to fingers of the person when opening or closing of the lock. The person holds the bow 101 in his/her hands (with fingers) when opening or closing the lock. The bow receives a rotational and/or translational movement from the fingers of the person and transfers this force to the shank 102. The purpose and shape (dimensions) of the bow 101 depend on ergonomic factors, sizes of the fingers of the person, the need to position the key 100 itself before inserting it in the keyhole 201, and the human ability to apply the forces required to move the bolt 204.

The shank 102 is part of the key which has the following several functions:

- combining the bow 101 and the key secret 103 (or several key secrets 103) into a single structure, referred to as the key 100;
- transferring the rotational and/or translational motion from the bow 101 to the key secret 103 to deliver the key secret 103 through the keyhole 201 to the secret mechanism 202, since the secret mechanism 202 of the lock is usually located far into the lock body 205 to make it difficult to open the lock 200 without authorization;

transferring the rotational and/or translational motion from the bow 101 to the key secret 103 to activate the secret mechanism 202;

transferring the rotational and/or translational movement from the bow 101 to the bolt drive 203 to provide the rotary and/or translational movement of the bolt drive 203 directly or through other elements of the lock 200;

hindering access to the secret mechanism 202 of the lock by increasing the length of the shank 102 and providing its special complex shape;

hindering the unauthorized opening of the lock 200 by arranging several key secrets 103 on the shank 102 (and consequently, by arranging a corresponding number of secret mechanisms 202 of the lock in the lock 200).

The set of functions of the shank 102 is usually combined in time. For example, in the cylinder mechanism of the pin tumbler lock, the function of inserting the key 100 in the keyhole 201 to deliver the key secret 102 to the secret mechanism 202 of the lock simultaneously provides two more functions of activating the secret mechanism 202 of the lock and connecting the secret mechanism 202 of the lock with the bolt drive 203. By combining the execution of these several functions in one movement, it is possible to make it easier for a person to use the lock and to increase the consumer value of such a locking mechanism 300.

The shank 102 of the lever tumbler lock is another example of how to successively combine different functions. In particular, it transfers a rotational force to the key secret 103, thereby setting the key secret 103 in a desired position to activate the secret mechanism 202 of the lock (to raise levers to a desired height) first and then to move the bolt drive 203 by the key secret 103 when the shank 102 continues to rotate further.

One more example of performing several functions is a rotational movement of the shank 102. The force from this rotational movement in the pin tumbler lock is provided to the keyhole 201 which transfers the rotational movement to a part of the secret mechanism 202 of the lock (to the cylinder). The part of the secret mechanism 202 gains (in case of matching all elements of the key secret 103 with pins of the secret mechanism 202 of the lock) the ability to perform rotational movement, receives the rotational movement from the bow 101 and actuates the bolt drive 203 (a catch of the pin tumbler lock).

The key secret 103 is responsible for performing the main function of the locking device 300 (opening the lock 200 only with a suitable key 100) and comprises protrusions, recesses, chamfers, curved, flat, three-dimensional and other geometric figures which, when delivered to the secret mechanism 202 of the lock, activate the secret mechanism 202 of the lock (make it possible to transfer the rotational and/or translational motion from the bow 101 through the shank 102 and/or the key secret 103 to the bolt drive 203). There may be several key secrets 103 in one key 100, while there may be several secret mechanisms 202 in the lock 200.

The bolt drive 203 is a device that is locked by the secret mechanism 202 of the lock in one of the states ("open" or "closed"). If the secret mechanism 202 of the lock is activated (a suitable key secret 103 is delivered to the secret mechanism 202 of the lock through the keyhole 201), the bolt drive 203 may perform a rotational and/or translational movement under the action of the force transferred from a human hand through the bow 101, the shank 102, and optionally through the key secret 103 to the element of the lock 200 which is intended to receive this force. For example, in the level tumbler lock, the shank 102 and the key secret 103 are used to transfer the movement from the bow 101 to the bolt drive 204, while, in the pin tumbler lock, the force from the bow 101 is received by walls of the keyhole 201 through the shank 102.

The keyhole 201 is a device used to deliver the key secret 103 to the secret mechanism 202 of the lock. As a rule, the keyhole 201 comprises elements that make it difficult to open the lock 200 without authorization, hinder access to the secret mechanism 202 of the lock, and hinder the possibility of opening the lock 200 by using lockpicks, curls, bumping and other devices.

In the pin tumbler lock, the role of the secret mechanism 202 of the lock is taken on by pins representing spring-loaded pairs of cylinders of various lengths which are coaxially mounted in one hole, while protrusions and recesses on the key 100 take the role of the key secret 103. The activation of the secret mechanism 202 of the lock occurs when a suitable key secret 103 is delivered to secret mechanism 202 of the lock through the keyhole 201. If the key 100 fits the lock 200, they are parts of the same locking device 300. In case of using a suitable key 100 in the pin tumbler lock, the pairs of cylinders of all pins are aligned and the activated secret mechanism 202 of the lock allows the force from the bow 101 (the part of the key which is not inserted in the delivery channel 201 and which is held with human fingers) to be transferred to the bolt drive 203. In this type of locks, the keyhole 201 used to deliver the key secret to the secret mechanism 202 of the lock is a profiled slot in which the shank 102 with the key secret 103 is inserted. When the corresponding key secret 103 is properly arranged in the keyhole 201, the secret mechanism 202 of the lock will be activated.

The prior art also discloses locks 200 in which, upon activating the secret mechanism 202, the lock 200 is passed from one state into another state by moving not the bow 101 but a different control element, for example, by turning a lock handle 209. As a rule, this action should be performed after the secret mechanism 202 of the lock is activated by turning the key 100. Then, the key 100 may be removed from the keyhole 201 (a keyhole). By subsequently rotating the lock handle 209, the lock 200 will be passed from one static state into another static state, thereby meaning the end of the working stroke of the lock 200. In such locks 200, the end of the working stroke of the lock 200 occurs upon the expiry of a certain time interval from the time of removing the key 100 from the keyhole 201 (the keyhole).

The prior art discloses locks 200 in which, prior to activating the secret mechanism 202, it is required to turn, for example, the lock handle 209 before the key 100 is inserted in the keyhole 201 (the keyhole), for example, to remove a security shutter of the keyhole. In such locks 200, the beginning of the working stroke of the lock 200 occurs for a certain period of time before the key 100 is inserted in the keyhole 201 (the keyhole).

Let us consider the operation of these assemblies of the locking device 300 one by one. The locking device 300 has the static states "open" and "closed" and the working strokes "opening" and "closing". In the state "open", the bolt 204 is located inside the lock body 205 and/or is not connected to a door frame and does not prevent the door from opening. In the state "closed", the bolt 204 project from the lock body 205 and/or is connected, directly and/or through necessary devices, to the door frame and does not allow the door to be opened. To change the state of the lock 200, it is necessary to perform the working stoke, i.e. to perform a certain sequence of actions that change the static state of the lock 200 from "open" to "closed", and vice versa.

The sequence of actions required to perform the working stroke of the lock 200 depends on the design of the lock 200, for which reason the shortened term "during the working stroke" which will be used further implies the completion of all actions required to transfer the lock 200 from one static state to another static state. Such actions comprise those indicated as follows: " . . . is performed (inserted, divided, connected, etc.) . . . during the working stroke", or as "performing (inserting, dividing, connecting, etc.) . . . during the working stroke",—i.e. the actions that are performed and/or in the process of preparing for the working stroke, and/or during the execution of the working stroke itself, and/or between any parts of the working stroke, and/or after the completion of this working stroke.

In the present group of inventions, the beginning of the working stroke of the lock 200 is considered to be the beginning of the first of the actions required to change the static state of the lock 200, including those (if any) that are performed prior to inserting the key 100 in the keyhole 201. The end of the working stroke of the lock 200 is considered to be the end of the last of the actions required to change the static state of the lock 200, including those (if any) that are performed upon removing the key 100 from the keyhole 201.

All actions performed between the beginning of the working stroke and the end of the working stroke (all actions performed using the key 100 and the lock 200, and all actions performed by the elements of the key 100 and the lock 200) are considered herein to be actions performed "during the working stroke" of the lock 200.

To perform the working stroke of the lock 200, it is necessary to activate the secret mechanism of the lock 202. For this purpose, the key secret 103 is inserted in the keyhole 201. If the key secret 103 matches the secret mechanism 202 of the lock, the secret mechanism 202 of the lock is activated. After the activation, the secret mechanism 202 of the lock unlocks the bolt drive 203. Then, the working stroke of the lock is performed, in which the bolt 204 is moved from one static position to another static position. This is done by transferring the force from a human hand through the bow 101, the shank 102, and/or the key secret 103 to the bolt drive 203. If the code key 103 does not fit the secret mechanism 202 of the lock, the bolt drive 203 will be locked by the secret mechanism 202 of the lock. The movement of the bolt 204 from the state "open" to the state "closed" (the execution of the working stroke "opening" or "closing") and vice versa is not possible in this case.

As a rule, each person has several keys (home, work, car, mailbox keys, etc.). The main disadvantage of such a key is caused by its mass and the size of the bow 101 and the shank 102 relative to the size and weight of the key secret 103.

The weight and dimensions of the key 100 and its metal consumption therein are mainly defined by the bow 101 and the shank 102, while the key secret 103 usually has dimensions which are 1/10-1/20 of the dimensions of the rest parts of the key 100.

There are many ways to reduce the dimensions and weight of the keys 100. These are keys of a master key system 100 which is known from the prior art and allows one key 100 to be used for many locks 200. However, this solution requires using a group of locks 200 having one set of secret mechanisms 202 at home, at work, and in the car, which is inconvenient from a practical point of view.

The prior art also discloses using combination locks 200 which is not provided with a physical key 100 at all, and in which the key secret 103 is a combination of numbers, letters, signs, symbols, hieroglyphs that are inputted in the lock 200 by using a keyboard, disks, levers, and all other elements of the key 100 are resided in the lock 200. This solution allows a person not to carry the key 100. However, this method has a significant drawback associated with the distribution of the key secret 103 (code) among colleagues and friends, thereby making it impossible to use this lock by its main purpose, i.e. protection against unauthorized access.

The prior art also discloses a method of manufacturing the key 100 based on light materials. The disadvantages of this method are both the rapid wear of the key 100 and the preservation of the large dimensions of the key 100.

The prior art discloses a lock-handle 200 (a knob lock) which is often mounted on interior doors. It involves manufacturing a key 100 having a reduced bow 101 and a shank 102 of reduced cross section which are both used to transfer the small force required only to unlock the secret mechanism 202 of the lock. The transfer of force to the bolt drive 203 is performed by the lock handle 209 rather than the bow 101.

In this lock-handle, it is first required to deliver the key secret 103 to the secret mechanism 202 of the lock through the keyhole 201 by performing the translational movement of the bow 101 connected to the shank 102 and the key secret 103. This action activates the secret mechanism 202 of the lock. Then, it is necessary to impact the keyhole 201 by performing the rotational movement of the bow 101 and the shank 102 connected thereto and to release the bolt drive 203 by turning the cylinder comprising this keyhole 201.

After these actions are performed, it will be possible to transfer the movement to the bolt drive 203 and move the bolt 204 by turning the lock handle 209.

This lock-handle 200 allows significantly reducing the dimensions and weight of the key 100, but facilitates forceful opening of such a lock-handle 200 because an intruder may act on the large-sized lock handle 209 which performs one of the functions of the bow 101—i.e. transferring the movement from a human hand to the bolt drive 203,—thereby applying a considerable force to the secret mechanism 202 of the lock. A much lower resistance to the forceful opening of such locks-handles 200 limits their use.

An analogue for the present group of inventions is an invention disclosed in RU 2229575, in which various functions of the bow 101 are alternately performed by the bow 101 itself and the lock handle 209 of the lock 200. In the known invention, the shank 102, the bow 101 and the key secret 103 are made as parts of a bracket, and the bow 101 performs only the function of inserting the key 100 in the keyhole 201. A person holds the bow 101 of the key 100 when he/she inserts the key 100 in the keyhole 201. The rest functions of the bow 101 and the shank 102 are performed by an additional control element, i.e. the lock handle 209 of the lock 200. By rotating and/or moving the lock handle 209, the person actuates the mechanisms of the lock 200 which move the key 100 through the keyhole 201 to the secret mechanism 202 of the lock and then, if a suitable key is inserted, perform the working stroke of the lock 200.

In this analogue, the key secret 103 is inserted by a human hand holding the bow 101 connected to the key secret 103 in the keyhole 201 and then delivered to the secret mechanism 202 of the lock by pressing the lock handle 209 of the lock 200, i.e. by performing the translational movement of the lock handle 209 which serves at this moment as the bow 101 and the shank 102. The transfer of force to the bolt drive 203 is performed with the rotational movement of the lock handle 209.

However, this analogue has significant drawbacks. The key secret 103 needs to be inserted in the keyhole 201 located at the bottom of the lock handle 209 and removed therefrom by holding the non-ergonomically shaped bow 101 with fingertips 101. These actions have to be performed at the lumbar level, which defines the large dimensions of the key secret 103 and its unusual shape. Such actions are uncomfortable and not visually controllable.

After the key 100 is inserted in the keyhole 201, it is necessary to perform a certain sequence of several actions that is not obvious to a person due to its complexity. Such a key 100 cannot be used in the most common types of locks 200, which also prevents the widespread use of this known invention.

This analogue and the present group of inventions have the following common features: the keyhole 201 which is accessible externally in the static state of the lock 200 is separated, together with the whole key 100, from the external space during the working stroke of the lock 200. However, there is a significant drawback peculiar to this lock 200: since the secret mechanism 202 of the lock is accessible externally for an intruder during the static state of the lock 200, the lockpicking resistance is reduced.

One other analogue for the present group of inventions is a key 100 disclosed in RU 2015117933, which comprises a movable element configured to perform a movement relative to an axis fixed in the key, while impacting the secret mechanisms of the lock. This increases the resistance of the lock to opening with lockpicks. However, this analog has drawbacks. The key 100 is made as a whole, without the possibility of dividing it into parts. The key 100 is a carrier of the movable element which performs the movement together with the key 100 and an additional movement within a window of this key 100 and cannot be separated from the key 100. The complexity of such a key 100 and the small dimensions of the movable element increase the labor intensity and cost of such a key 100. The analogue makes it difficult for an intruder to access the secret mechanism 202 of the lock but does not exclude this possibility.

A prototype for the present group of inventions is a key 100 disclosed in RU 2132438. The key 100 is provided with a grab 104 attached to a shank 102 in the middle of the shank 102. The grab 104 divides the key 100 into two approximately equal parts, which facilitates portability and storageability the long safe key 100. However, this solution has drawbacks. Such a key 100 is assembled and disassembled before its use outside the lock 200, and not in the lock 200 and not during the working stroke of the lock 200. The assembly and disassembly of the key 100 is performed by a person but not a device. It takes time to assemble and disassemble such a key 100. Due to the complex shape of the shank 102, these actions require visual control and good lighting, and they are difficult to perform by touch, thereby making it difficult to use such an invention. Such a key 100 cannot be used in the most common types of locks 200, which also narrows the scope of its application.

The prototype above comprises the set of features which is the closest to the set of essential features of the present group of inventions, since it comprises the grab 104 which performs the function of disassembling the key 100 into the parts. One part of the key 100 comprises the bow 101, one half of the shank 102, and one half of the grab 104, while another part of the key 100 comprises another half of the grab 104, another half of the shank 102 and the key secret 103.

In the present group of inventions, these known features of the prototype are complemented with a new feature which is easily implemented in practice, industrially applicable, but previously unknown, unobvious from the prior art, and involving an inventive step—i.e. the use of a grab 104 in the key 100 with the possibility of disassembling the key 100 into parts during the working stroke of the lock 200.

The main technical problem, the solution of which is provided when implementing or using the present group of inventions, and which could not be solved when implementing or using the analogues and prototype of the present group of inventions, consists in:

- reducing the size and weight of a bunch of keys 100 due to the disassembly of the key 100 into parts, as known from the prototype, and assembling it into a single whole before use, with the aid of the following previously unknown features of the group of inventions:
  - the use of removable key secrets 103;
  - the standardization of the grab 104;
  - the standardization of the key secrets 103;
  - the connection of different key secrets 103 to one grab 104;
- increasing the security of the locking device 300 due to the difficulty of accessibility of combination master keys, vibration master keys, bump keys, etc., to the secret mechanism 202, as known from the analogues, but through the keyhole 201, using the following previously unknown features of the group of inventions:
  - the use of the capture 104 in the key 100 with the possibility of dissembling the key 100 into parts during the working stroke of the lock 200;
  - the disassembly of the key 100 into parts during the working stroke of the lock 200;
  - the use of the movement received from a human hand separated from the key secret 103 by the bow 101 in order to perform the working stroke of the lock 200;
  - the disassembly of the keyhole 201 into parts;
  - the installation of keyhole barriers 207;
- the connection of the keyhole 201 to a key secret delivery mechanism 212 in a position other than the connection position of the key secret delivery mechanism 212 to the secret mechanism 202;
  - the use of a docking mechanism 206 performing the functions of assembling the key 100 from the parts and disassembling the key 100 into the parts;
  - the use of a keyhole separator 208;
  - the use of the key secret delivery mechanism 212;
  - the use of a keyhole barrier mechanism 215.
- increasing the security of the locking device 300 by eliminating the very possibility for an intruder to receive feedback from the secret mechanism 202 when the intruder acts on the bow 101 and through the bow 101 by influencing the unsuitable key secret 103 on the secret mechanism 202, with the aid of the following previously unknown features of the group of inventions:
  - the use of the grab 104 in the key 100 with the possibility of disassembling the key 100 into the parts during the working stroke of the lock 200;
  - the disassembly of the key 100 into the parts during the working stroke of the lock 200;
  - the use the movement received from a human hand separated from the key secret 103 by the bow 101 in order to perform the working stroke of the lock 200;

the installation of the key barriers 210 between the parts of the disassembled key 100;

the interaction of the key secret 103 with the secret mechanism 202 separated from the bow 101;

the use of a key barrier mechanism 211;

the use of the key secret delivery mechanism 212 implemented according to the shuttle principle.

The reasons which do not allow the analogues and prototype of the group of inventions to solve this technical problem and obtain the technical result provided by the group of inventions are as follows:

the accessibility of the secret mechanism 202 from the outside;

the accessibility of the keyhole 201;

the use of the non-assembled key 100.

The technical result of the present group of inventions is the creation of an object whose characteristics meet the specified requirements:

the permanent inaccessibility of the secret mechanism 202 from the outside;

the inaccessibility of the keyhole 201 during the working stroke.

SUMMARY

It is an objective of the group of inventions to reduce the size and weight of a bunch of numerous keys 100 from locks 200, which are installed in doors of an entrance, apartment, office at work, etc., that is, those keys 100 that a person carries with him/her, and to increase the durability of these locks 200 to be opened by an intruder using lockpicks, curls, bumping, etc. methods.

The technical result of the claimed invention consists in providing the reduced weight, dimensions and the metal consumption of the keys 100 carried by a person, excluding access to the secret mechanism 202 through the keyhole 201, increasing the lockpicking resistance of the lock 200.

The present group of inventions eliminates the disadvantages of the analogues and prototype, since it allows using the grab 104 to attach, to one lock 100, different key secrets 103 suitable for different locks 200 having different secret mechanisms 202. This allows a person to store and transport, on his/her bunch of keys, only one key 100 with a bow 101, a shank 102 and a grab 104 and several key secrets 103 from different locks 200, but not several overall and heavy keys 100 with bows 101, shanks 102 and key secrets 103.

An additional important advantage of the present group of inventions is the possibility of disassembling the key 100 during the working stroke of the lock 200, which increases the security of the locking device 300 and makes it difficult to perform unauthorized access to the secret mechanism 202 of the lock 200.

The grab 104 in the present group of inventions can be performed by any known or unknown method, for example, by using a magnet or magnets and magnetic material, geometric shapes (grooves and projections, cones and tapered holes, cylindrical pins and corresponding holes), springs, hooks, adhesive (adhesive) substance/substances, capillary surface tension forces, friction forces, electromagnetic attraction/repulsion forces, electrostatic attraction/repulsion forces, plastic deformation, elastic deformation, elastic elements, thermally expandable devices and any combination of these known and unknown methods, allowing one to separate and connect two different elements of the key 100. One of the options for arranging such a grab 104 is to arrange the grab 104 at the junction of the key secret 103 and the shank 102 of the key 100, which allows the key to be disassembled in the most economical way in terms of reducing metal consumption and weight saving. Another option for placing the grab 104 can be its arrangement in the shank 102, leaving the necessary space for capturing a part of the key 100 (the key secret 103 and a part of the shank 102) by the newly introduced element of the lock 200 in these cases—i.e. the docking mechanism 206.

Since an individual feature of each key 100 is only its key secret 103, and by making the shank 102 and/or the bow 101 with a new element—i.e. the grab 104 which allows one to attach various key secrets 103 to the shank 102 and/or the bow 101, it is possible to have one key 100 (with the bow 101, and/or the shank 102 and the grab 104), in which different key secrets 103 may be installed, thereby making it possible to open several locks with this one key. The present group of inventions may also improve the reliability of the lock, since it will allow the key secret 103 to be delivered deep into the lock body 205 up to the secret mechanism 202 located in a hard-to-reach place for burglars and, if necessary, to disconnect the key secret 103 from the shank 104. Such a grab may be connected and/or disconnected not only by a person, but also by the docking mechanism 206 of the lock 200. Such a docking mechanism 206 may be implemented in a variety of known ways.

For example, being connected by a magnet (which, in this case, represents the grab 104) with the remaining parts of the key 100, that part of the key 100 which contains, in addition to the remaining elements of the key 100 or the parts of the remaining elements of the key 100, the key secret 103 (for example, part of the key 100 containing a smaller half of the shank 102 and the key secret 103), can be captured by a groove made in a rotating or translational docking mechanism. The mechanical forces of movement of the docking mechanism 206 can overcome the attraction force of the magnet (grab 104), and the key secret 103 together with the other elements of the key 100 can be moved along the keyhole 201 to the secret mechanism 202, while the remaining elements and parts of the elements of the key 100 (for example, the bow 101 and a greater half of the shank 102) will remain stationary or move separately from the key secret 103.

The keyhole 201 during such a movement may be closed when the docking mechanism 206 moves or any other element of the lock or their combination moves (the secret mechanism 202, the bolt drive 203, the bolt 204, the lock body 205, etc.), which makes it difficult for an intruder to open the lock.

The keyhole 201 may be divided by a keyhole barrier 207 (curtain, sector, circle, etc.) into an outer (accessible from the outside by both a conscientious person and an intruder) keyhole 201-1, which does not have access to all or to a part of the secret mechanism 202, and an inner keyhole 201-2, which has access to all or the rest of the secret mechanism 202 but is inaccessible from the outside to no one either when the key 100 is inserted, or when the key 100 is removed. The movement of the key secret 103 from the outer keyhole 201-1 to the inner keyhole 201-2 may be performed by each of the docking mechanism 206, the secret mechanism 202, and the keyhole separator 208, or jointly by any of these mechanisms, or this action may be performed by any other mechanism known or unknown from the prior art.

The operation of such a lock 200 is simple and natural for a person. The key 100 is held by the bow 101 and is inserted in the keyhole 201, and then the bow is rotated in the right direction. The grab 104 is disconnected under the action of the docking mechanism 206. The keyhole 201 is divided by the keyhole barrier 207 into the outer keyhole 201-1 and the inner keyhole 201-2. The part of the shank 102 with the bow 101 and a part of the grab 104 is left in the outer keyhole 201-1, and this part of the shank 102 with the bow 101 and the part of the grab 104 is blocked from accidental or deliberate extraction during the disassembled state of the key 100. The counterpart of the grab 104, part of the shank 102 and the key secret 103 are placed in the inner keyhole 201-2 separated from the outer keyhole 201-1 by the keyhole barrier 207. The key secret 103 with the elements of the key 100 attached thereto is captured by the docking mechanism 206, and the key secret 103 with the elements of the key 100 attached thereto is moved by the docking mechanism 206 to the secret mechanism 202 which is isolated from the keyhole 201 and which is connected only to the docking mechanism 206 in a certain position. This position in which the docking mechanism 206 is connected to the secret mechanism 202 is different from the position in which the docking mechanism 206 is connected to the keyhole 201. The secret mechanism 202 is activated, and the lock 200 is opened. The lock 200 is closed in reverse order.

The present group of inventions provides a method for increasing the security of the lock. When characterizing the method, it is required to perform the following steps:

1. Describe a sequence of actions (operations) carried out when implementing the method. In this case, it is desirable to indicate which of the operations are strictly required, and which of the operations are optional. If several variants of the sequence of actions in the method are possible, all of them should be indicated;
2. Describe in detail each operation of the method, technical means used therefor and possible conditions for its implementation (options for substances used, pressure, temperature, etc.);
3. Give at least one implementation example of the method, while indicating specific conditions for its implementation (specific compositions of materials, modes, etc.);
4. Indicate what advantages this method has, in comparison with previously used similar technologies, if any, and also what technical result (technical effect) is achieved.

Section 5 "Detailed description" recites the sequences of actions required to implement the claimed methods, indicates mandatory and optional steps, provides options for the sequences of actions, describes in detail each of the operations of the claimed methods, the technical means used for their implementation, gives implementation examples of the claimed methods, indicates their advantages and technical result provided when implementing these methods.

The present group of inventions provides a device for increasing the security of the lock. When characterizing the device, it is required to perform the following steps:

1. Describe its design, i.e. all essential components (elements) included in the device. It is advisable to indicate which of the device components are strictly mandatory and which of them are optional. If several design options are possible, all of them should be indicated.
2. Describe the characteristics and purpose of each component of the device (design, material, etc.).
3. Describe how the elements of the device are related to each other.
4. Describe how each component operates separately and how the device as a whole operates.
5. Indicate what advantages the proposed device has, in comparison with similar previously known designs, as well as what technical result (technical effect) is achieved.

Figure 1:
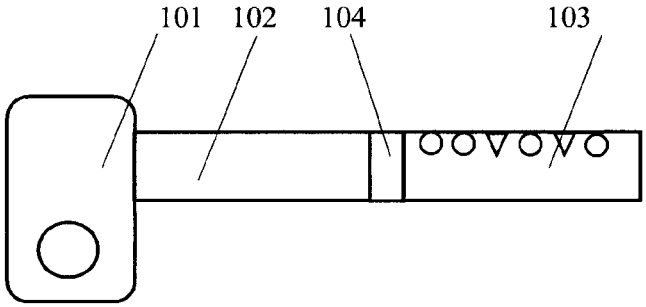
FIG. 1 shows a disassemble key 100, a bow 101, a shank 102, a removable key secret 103 and a grab 104 made, for example, of permanent magnets with a required clamping force, which can be fixed in the shank 102. In this case, the key secret 103 has the ability to disconnect and connect with the grab 104. The grab 104 interacts with the key secret 103, made, for example, of steel, attracts it and thereby keeps the key secret 103 in the attached position. The connection and disconnection of the key secret 103 with the grab 104 may occur both outside the lock 200 and inside the lock 200 during the working stroke of the lock 200.

The grab 104 may be configured to be detachable and attachable to the shank 102. In this case, the grab 104, when released, moves in conjunction with the key secret 103. The connection and disconnection of the shank 102 and the grab 104 may also occur both outside and inside the lock 200 during the working stroke of the lock 200.

The grab 104 may be configured to connect to and disconnect from both the shank 102 and the key secret 103. In this case, the grab 104 may be detached from both the shank 102 and the key secret 103, and all these parts of the key 100 may move independently and independently of each other. The connection and disconnection of the shank 102, the grab 104 and the key secret 103 may also occur both outside and inside the lock 200 during the working stroke of the lock 200.

Figure 2:
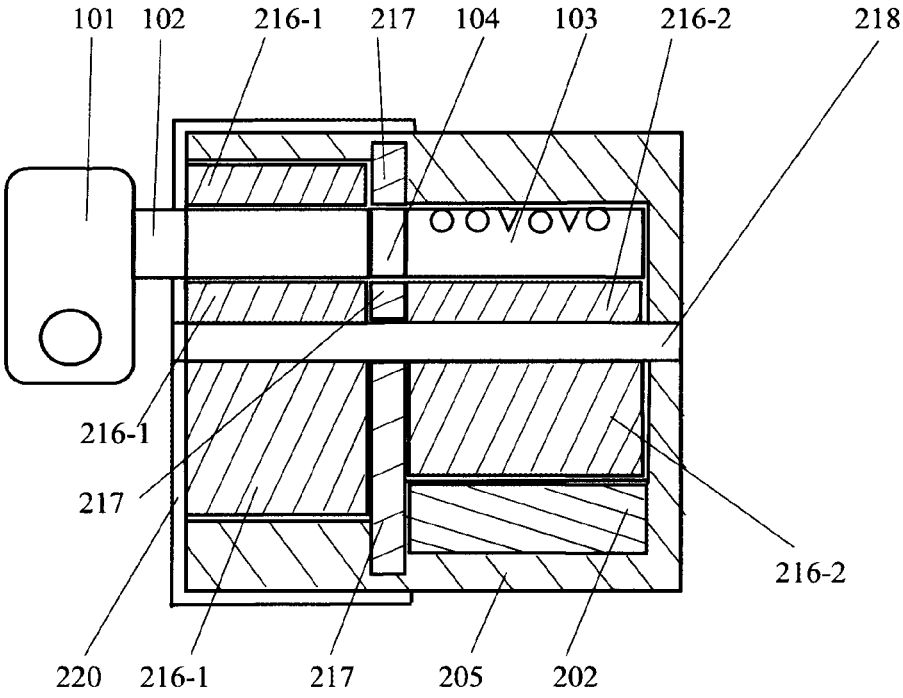

FIG. 2 shows a sectional view of a lock 200 in a static state with the key 100 inserted in the keyhole 201. Also shown is a lock body 205, an opening 219, a stopper cover 220, a dual cylinder 216 which consists of an outer coaxial cylinder 216-1 and an inner coaxial cylinder 216-2 and is fixed on a shaft 218 without the possibility of mutual movement. The outer and inner coaxial cylinders 216-1 and 216-2 are separated by a septum 217 comprising: a central hole 217-1 in which the shaft 218 freely rotates; and an eccentric shaped hole 217-2 which, in the static position shown in FIG. 2, coincides with the outer and inner keyholes 201-1 and 201-2 formed in the outer and inner coaxial cylinders 216-1 and 216-2, thereby forming together the keyhole 201.

The grab 104 is located in the eccentric shaped hole 217-2, which serves as a cavity for the grab 104. The key secret 103 is in the inner keyhole 201-2, and the shank is in the outer keyhole 201-1.

The secret mechanism of the lock 200 in this static position has no connection with the keyhole 201, since this mechanism 201 is offset by a required number of degrees around the circumference of the opening 219 (for example, 180 degrees).

Figure 3:
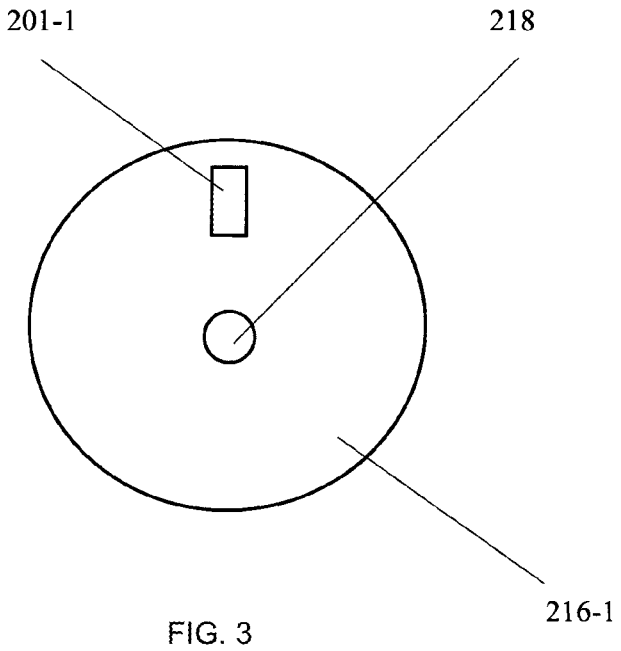

FIG. 3 shows the outer cylinder 216-1, the shaft 218 and the outer keyhole 201-1 provided in the outer cylinder 216-1. The outer cylinder 216-1 is shown from the outside of the lock 200 in the same static state as the lock 200 shown in FIG. 2. The key 100, the lock body 205 and the stopper cover 220 are not shown schematically.

Figure 4:
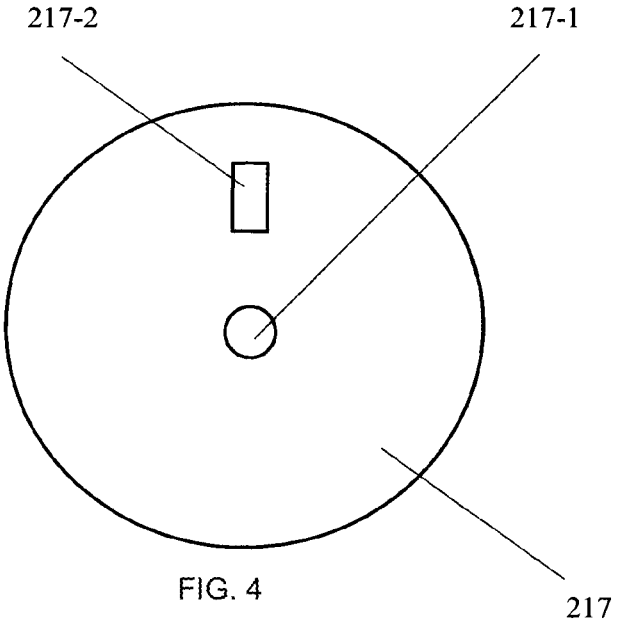

FIG. 4 shows the fixed septum 217 having the holes 217-1 for the shaft 218 and the eccentric shaped hole 217-2. In the static state of the lock 200, this eccentric shaped hole 217-2 connects the outer keyhole 201-1 and the inner keyhole 201-2. This eccentric shaped hole 217-2 also serves as a cavity for the grab 104.

The fixed septum 217 is shown from the outside of the lock 200 in the same static state as the lock 200 is shown in FIG. 2. The key 100, the lock body 205, the stopper cover 220, the outer cylinder 216-1 and the shaft 218 are not shown conventionally.

Figure 5:
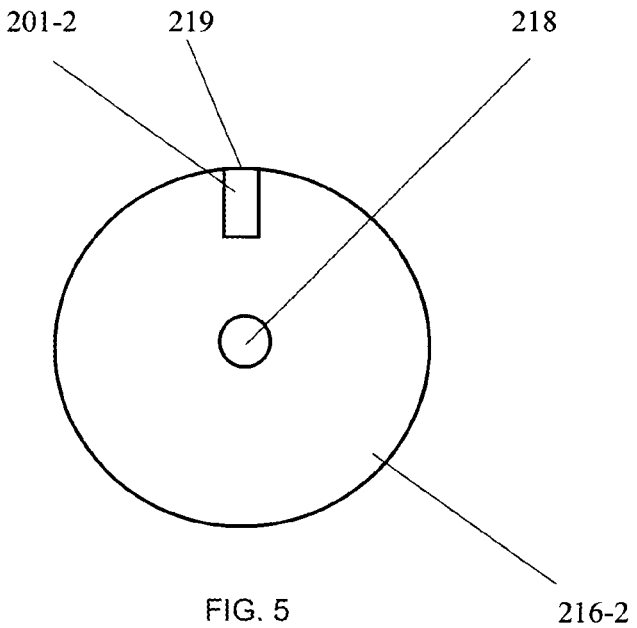

FIG. 5 shows the inner cylinder 216-2, the shaft 218, the inner keyhole 201-2 in the inner cylinder 216-2, and the cavity 219 that is used to access the key secrets. The inner cylinder 216-2 is shown from the outside of the lock 200 in the same static state as the lock 200 in FIG. 2. The key 100, the lock body 205, the stopper cover 220, the outer cylinder 216-1 and the fixed septum 217 are not shown schematically.

Figure 6:
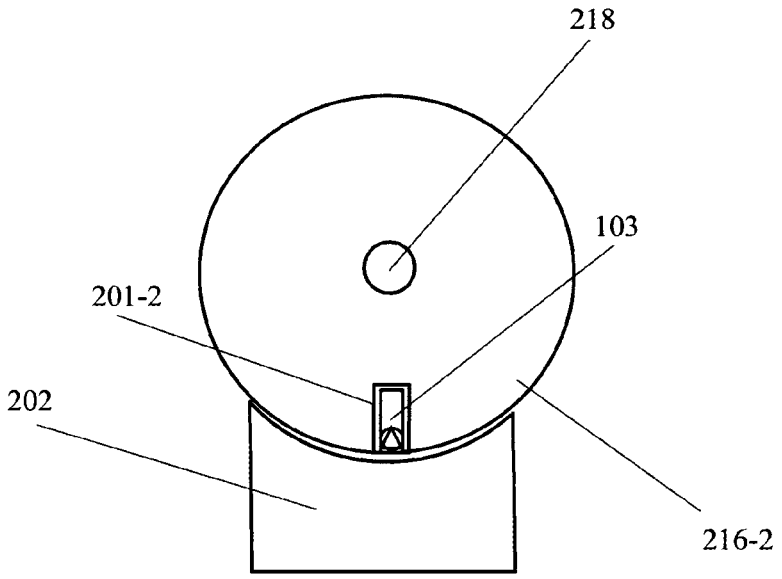

FIG. 6 shows the inner cylinder 216-2, the shaft 218, the inner keyhole 201-2, the key secret 103, and the secret mechanism 202. The outer cylinder 216-1 is shown at the time of the working stroke in the activated state, in which the key secret 103 separated from the rest of the key 100 is delivered to the secret mechanism 202. The lock body 205, the stopper cover 220, the outer cylinder 216-1, and the fixed septum 217 are not schematically shown.

Figure 7:
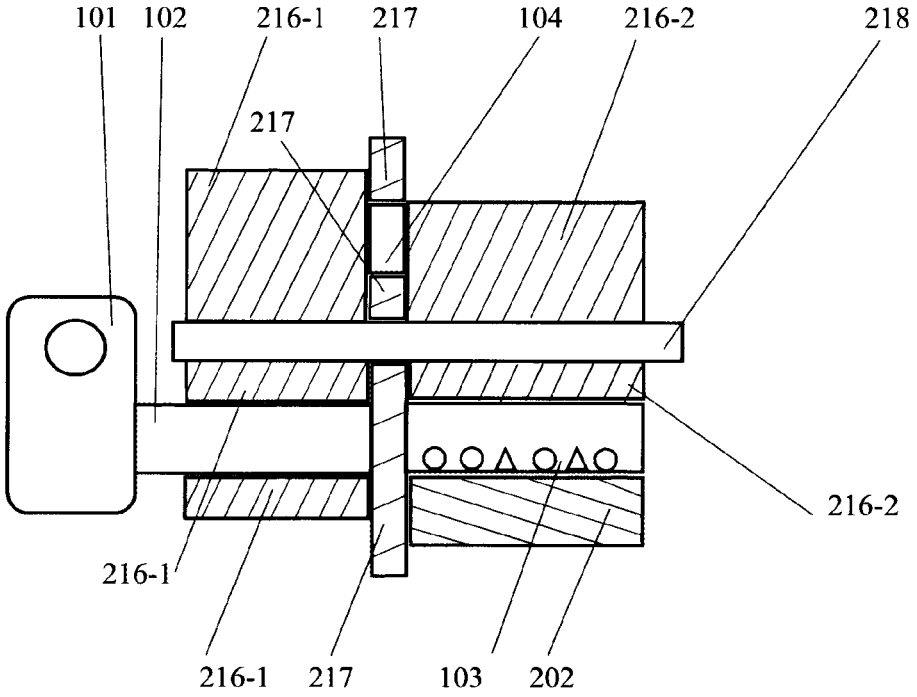

FIG. 7 shows a sectional view of the lock 200 during its working stroke, which is in the activated state, when the outer cylinder 216-1 and the inner cylinder 216-2 connected by the shaft 218 made a rotational movement, for example, 180 degrees under the action of the bow 101 of the key 100.

Under the action of this rotational movement, at the junction of the rotating outer and inner keyholes 201-1, 201-2 and the stationary eccentric shaped hole 217-2 made in the fixed septum 217, a shearing force occurs, which is directed tangentially to the diameter of the dual cylinder 216.

This shearing force overcomes the magnetic attraction force of the grab 104 to the shank 102 and to the key secret 103 and separates the grab 104 from the key secret 103 and the shank 102.

This rotational movement disassembles the key 100 inserted in the keyhole 201 into three parts. The bow 101 and the shank 102 rotated 180 degrees together with the outer keyhole 201-1. The grab 104 remained in place in the eccentric shaped hole 217-2 of the fixed septum 217. The key secret 103 which is separated from the grab 104 turned 180 degrees together with the inner keyhole 201-2.

In this embodiment, the dual cylinder 216 and the fixed septum 217 act together as the docking mechanism 206 that disassembles the key 100 into the three parts and assembles the three parts of the key 100 into a single whole.

In this embodiment, the delivery of the key secret 103 to the secret mechanism 202 is performed by rotating the inner cylinder 216-2 which acts as the key secret delivery mechanism 212.

The other and inner keyholes 202-1 and 202-2 are separated by the fixed septum 217 which in this embodiment performs the functions of the keyhole barrier 207. The dual cylinder 216, together with the fixed septum 217, acts as the keyhole separator 208.

In this embodiment, the parts of the key 100 are separated by the fixed septum 217 which also serves as a key barrier 210. The dual cylinder 216 also, together with the fixed septum 217, performs the functions of the key barrier mechanism 211.

In this embodiment, the outer and inner keyholes 202-1 and 202-2 are separated by the fixed septum 217 which serves as the keyhole barrier 207. The dual cylinder 216, together with the fixed septum 217, act as a keyhole barrier mechanism 215.

In this embodiment, the grab 104 is separated from both the key secret 103 and the shank 102 and is located in the eccentric shaped hole 217-2 which is made in the fixed septum 217 and serves as a cavity for the grab 104.

The key secret 103 is in the inner keyhole 201-2, and the key shank is in the outer keyhole 201-1.

The secret mechanism of the lock 200 in this position of the lock 200 is connected to the keyhole 201. The key secret 103 is delivered to the secret mechanism 202 of the lock 200. If the key secret 103 matches the secret mechanism 202, then the secret mechanism 202 will be activated, and upon further execution of the working stroke, the lock 200 will be transferred into a different static state.

DETAILED DESCRIPTION

This section provides a detailed description of the design of the device, the characteristics and purpose of each of the elements of the device, the properties of the structural elements and the material from which the structural elements are made, the connection of the elements of the device with each other, the advantages and technical result of the group of inventions are described.

All the essential features of the group of inventions are sequentially listed below, and the description of each of the features is then presented, depending on what (device or method) refers to the claimed feature.

The first essential feature of the group of inventions is a hitherto unknown method of disassembling a key 100 into parts during the working stroke of a lock 200, as well as the corresponding device—i.e. the dismountable key 100 with a grab 104 and the lock 200 with a docking mechanism 206, which disassembles the key 100 into parts during the working stroke of the lock 200.

The sequence of actions carried out in the implementation of the claimed method is as follows. The key 100 is held by a bow 101 in a conventional manner and is inserted in the keyhole 201 in a conventional manner. Then, in a conventional manner, the bow 101 begins to rotate and/or move in a desired direction. The grab 104 is disconnected by the proposed method under the action of the docking mechanism 206 and/or another lock mechanism that performs the same function. The keyhole 201 is divided by the proposed method into an outer keyhole 201-1 and an inner keyhole 201-2 by mutually moving the parts of the keyhole 201 and/or installing a keyhole barrier. In the proposed method, a part of a shank 102 with the bow 101 and a part of the grab 104 are left in the outer keyhole 201-1. In the proposed method, this part of the shank 102 with the bow 101 and the part of the grab 104 are blocked by a stopper 213 from accidental or deliberate extraction during the disassembled state of the key 100. In the proposed method, a counterpart of the grab 104, a part of the shank 102 and a key secret 103 are placed in the inner keyhole 201-2 separated from the outer keyhole 201-1 due to the movement and/or a keyhole barrier 207. In the proposed method, the key secret 103 with the elements of the key 100 attached thereto is captured by the docking mechanism 206 and/or another lock mechanism. In the proposed method, the key secret 103 with the elements of the key 100 attached thereto is moved by a key secret delivery mechanism 212 and/or another lock mechanism to a secret mechanism 202 of the lock 200. In the proposed method, the secret mechanism 202 is isolated from the keyhole 201. In the proposed method, the secret mechanism 202 is connected to the docking mechanism 206 and/or another mechanism of the lock 200 containing all or a part of the key secret(s) 103. This position in which the docking mechanism 206 is connected to the secret mechanism 202 of the lock 200 is different from the position in which the docking mechanism 206 and/or other mechanism of the lock 200 acting as the docking mechanism 206 is connected to the keyhole 201. The secret mechanism 202 of the lock 200 is activated in a conventional manner, and the lock 200 is opened in a conventional manner. The lock 200 is closed in reverse order.

One of the options in the claimed method is the following: the key 100 is inserted in the keyhole 201, the bow 101 is moved and/or rotated in a desired direction, the grab 104 is disconnected by the docking mechanism 206, the key secret 103 separated from the key 100 is captured by the secret delivery mechanism key 212, the key secret 103 is moved to the secret mechanism 202 by the key secret delivery mechanism 212, the secret mechanism 202 is activated, and the lock 200 is opened.

Strictly mandatory actions in the claimed method are the following actions performed in the specified sequence: the key 100 is inserted in the keyhole 201, the key 100 is disassembled into parts, the part of the key 100 containing the key secret 103 is delivered to the secret mechanism 202.

The rest of the actions according to the first feature of the group of inventions are optional. Several variants of the sequence of actions of the method are possible, in which the execution of a number of actions is combined in time. For example, inserting the key 100 in the keyhole 201 may immediately perform both the disassembling of the key 100 into parts and the blocking of the shank 102 and the bow 101 separated from the secret key 103 to prevent their removal from the keyhole 201, depending on the specific version of the key 100 and the lock 200.

The description of each action of the method, technical means used for performing these actions, and the conditions for carrying out these actions are given in the description of the corresponding devices.

An implementation example of the claimed method may be the key 100 of a lever tumbler lock, which comprises the key secret 103 attached to the shank 102 by using a magnet acting as the grab 104. When the key 100 is inserted in the keyhole 201 under the action of a wedge-shaped septum installed in the keyhole 201 and acting as the docking mechanism 206, this key secret 103 overcomes the magnetic attraction forces of the grab 104 and separates from the shank 102, after which it enters the groove of a cylinder of the docking mechanism 206. The axis of rotation of the cylinder of the docking mechanism 206 is parallel to the axis of rotation of the key shank. The cylinder of the docking mechanism 203 is rotated under the action of a gear made on the part of the shank 102. The key secret 103 moves along with a cylinder of the secret mechanism 201 and reaches the secret mechanism 202 inaccessible from the outside, where the key secret interacts with the secret mechanism 202, thereby activating it and opening the lock 200.

This method has advantages over previously used similar methods, since it completely excludes the possibility of external access to the secret mechanism 202 of the lock 200 through the keyhole 201. The technical result of the claimed method is an increase in the lockpicking resistance of the lock, which is achieved by using the dismountable key 100 whose key secret 103 moves separately from the bow 101.

The second essential feature of the group of inventions is a hitherto unknown method of disassembling the keyhole 201 into parts during the working stroke of the lock 200.

The sequence of actions carried out when implementing the claimed method may be as follows. The keyhole 201 is divided by the proposed method into the outer keyhole 201-1 and the inner keyhole 201-2 by mutual movement of parts of the keyhole. In the proposed method, a part of the shank 102 with the bow 101 and a part of the grab 104 are left in the outer keyhole 201-1. In the proposed method, a counterpart of the grab 104, a part of the shank 102 and the key secret 103 are placed in the inner keyhole 201-1 separated from the outer keyhole 201-1 due to the movement and/or the keyhole barrier 207.

The following actions are strictly obligatory in the claimed method: the keyhole 201 is divided into the outer keyhole 201-1 with a part of the key 100 and the inner keyhole 201-2 with the remainder of the key 100.

The rest of the actions according to the second feature of the group of inventions are optional. Several variants of the sequence of actions of the method are possible, in which the execution of a number of actions is combined in time.

An implementation example of the claimed method may be a groove of the cylinder of the docking mechanism 206. The axis of rotation of this cylinder of the docking mechanism 206 is parallel to the axis of rotation of the key shank. The cylinder of the docking mechanism 206 rotates under the action of a gear made on a part of the shank 102. The key secret 103 separated along the joint line of the grab 104 from the rest of the key elements moves together with the cylinder of the secret mechanism 201 and reaches the secret mechanism 202 inaccessible from the outside. The inner keyhole for the key secret 103 is formed in the claimed method by the groove in the cylinder of the docking mechanism 206 and by the walls of the lock body 205.

This method has advantages in comparison with previously used similar methods, since it completely excludes the possibility of external access to the secret mechanism 202 of the lock 200 through the keyhole 201. The technical result of the claimed method is an increase in the lockpicking resistance of the lock, which is achieved by using the dismountable keyhole 201.

The third essential feature of the present invention is a hitherto unknown method of installing the keyhole barrier 207 disassembling the keyhole 201 into parts during the working stroke of the lock 200.

The sequence of actions carried out when implementing the claimed method may be as follows. The keyhole barrier 207 is installed in the keyhole 201 by the proposed method, thereby dividing the keyhole 201 into the outer keyhole 201-1 and the inner keyhole 201-2. In the proposed method, the key secret 103 is placed in the inner keyhole 201-2 separated from the outer keyhole 201-1 by the keyhole barrier 207, and the key secret 103 is captured.

The following actions are strictly obligatory in the claimed method: the keyhole barrier 207 is installed in the keyhole 201 by the proposed method, thereby dividing the keyhole 201 into the outer keyhole 201-1 with a part of the key 100 and the inner keyhole 201-2 with the remainder of the key 100.

The rest of the actions according to the third feature of the invention are optional. Several variants of the sequence of actions of the method are possible, in which the execution of a number of actions is combined in time.

The description of each action of the method, technical means used for performing these actions, and the conditions for carrying out these actions are given in the description of the corresponding devices.

An implementation example of the claimed method may be the key 100 of the lever tumbler lock 200, which comprises the key secret 103 made in the form of a set of barbs, the grab 104 consisting of a tapered sleeve 103-1 connected to the non-working side of the key secret 103 and a tapered shaft 102-1 of the same tapering, which is made at the end of the shank 102 remote from the bow 101. When such a key 100 is inserted in the lock 200, the key secret 103 falls into the slot of a split collar 206-1 of the docking mechanism 206. The split collar 206-1 is made coaxially with the axis of rotation of the tapered shaft 102-1. The diameter of the split collar 206-1 is made smaller than the length of the non-working part of the key secret 103. The width and shape of the slot of this split collar 206-1 is made based on the width and shape of the non-working part of the secret key 103. The insertion of the key secret 100 in the split collar 206-1 and the withdrawal of the key 100 from the split collar 206-1 are limited to a slot of the same width and shape in a split washer 206-2. The split washer 206-2 is unable to rotate around the axis of the tapered shaft 102-1 of the shank 102, from which it is held by a radially directed sliding stud 206-8 of the split collar 206-1. The sliding stud 206-8 has one end rigidly fixed in the split washer and passing through a spiral slot in a sleeve of the keyhole 201, and another end placed in a longitudinal keyway slot made on the inner surface of the lock body 205. Due to the location of the sliding stud 206-8 in the keyway slot of the lock body 205, the split washer 206-2 is capable of translational movement along the axis of rotation of the tapered shaft 102-1 of the shank 102 together with the split collar 206-1. Inserting the key secret 103 in the split collar 206-1 and removing the key 100 from the split collar are possible only in one angular position of the split collar 206-1 relative to the split washer 206-2, in which the grab 104 is closed, i.e. the tapered sleeve 103-1 of the key secret is mounted on the tapered shaft 102-1 of the shank 102. This design of the docking mechanism 206 makes it impossible to extract the individual parts of the key 100 and allows only the fully assembled key 100 to be removed from the lock 200.

The keyhole 201 is made in the form of a sleeve coaxial with the split collar 206-1, and the split collar 206-1 is in the bore of the keyhole 201. The split collar 206-1 has the possibility of translational movement inside the sleeve of the keyhole 201. The split collar 206-1 also has the ability to rotate jointly with the sleeve of the keyhole 201, receiving it through a sliding insert 206-4. The sliding insert 206-4 has one end rigidly fixed in a keyway hole on the outer surface of the split collar 206-1, and another end sliding in the keyway slot on the inner the surface of the sleeve of the keyhole 201.

Under the action of this sliding insert 206-4, the split collar 206-1 receives a rotational movement, and the split collar 206-1 moves in the longitudinal direction along a fixed two-way spiral thread made on the outer surface of a pivot axis 206-3 of this split collar 206-1. One thread start of the pivot axis 206-3 is made in the left direction, and the second thread start is made in the right direction. The left and right thread starts are connected together at the beginning and at the end and form a bi-directional spatial spiral. When the split collar 206-1 rotates around the pivot axis 206-3 in any direction, the split collar moves to one side in the first half of the revolution and moves to the other side in the second half of the revolution. This movement of the split collar 206-3 resembles that of a piston in a crank mechanism. Drawing this analogy further, it is possible to designate the extreme positions of the split collar 206-1 as near and far dead centers. At the near dead center, the key secret 103 is connected to the shank 102, the grab 104 is closed. At the far dead center, the key secret 103 is delivered to the secret mechanism 202 and activates this mechanism in case of a suitable key.

The pivot axis 206-3 of the split collar 206-1 is rigidly attached at one end to the lock body 205 from the inner side of the lock 200 and enters the split collar 206-1 from its end located on the inner side of the lock 200 and located opposite to the end surface facing the keyhole 201.

When the bow 101 rotates, the shank 102 connected thereto rotates, by its square part, the keyhole 201. The latter transmits this rotation through the sliding insert 206-4 to the split collar 206-1. The non-rotating slot of the split washer 206-2, which is held from rotation by the sliding stud 206-8, overlaps the slot of the split collar 203-1. This overlap prevents the key secret 103 from being extracted from the split collar 206-1. As the bow 101 and the square shank 102 rotate further, the split collar 206-1 receives rotation from the square-bored keyhole 201.

Since the split collar 206-1 receives both a rotational and a translational movement, and the latter, in the case of insertion of the key 100, is directed from the shank 102, this translational movement removes the key secret 103 together with the tapered sleeve 103-1 attached thereto from the tapered shaft 102-1, thereby acting as a puller for bearings. Hence, the rotation of the bow 101 of the key brings the grab 104 to the open state and moves the key secret 103 together with the split collar 206-1 along the spiral thread of the pivot axis 206-3 deep into the lock 200, thereby delivering the key secret 103 to the secret mechanism 202.

The key secret 103 is separated from the shank 102 by the action of grab 104 and the docking mechanism 206, which allows the keyhole separator 208 and the key barrier mechanism 211 to completely block the keyhole 201, divide the keyhole 201 into the outer keyhole 201-1 and the inner keyhole 201-2 by the keyhole barrier 207, as well as to divide the parts of the key 100 by the key barrier 210. A bracket 206-5 is made in the form of a ratchet wheel or anchor of a clockwork; while rotating on a bracket axis 206-6 perpendicular to a pivot axis 206-7 of the split collar 206-1, and under the action of the translational movement of the split collar 206-1, one of parts of the bracket 206-5 opens a passage for access of the key secret 103 to the secret mechanism 202, thereby removing the key barrier 210, performing the function of the keyhole separator 208. Another of the parts of the bracket 206-5 closes the passage to the key secret 103 from the side of the keyhole 201 and the shank 102, thereby setting up the keyhole barrier 207, while performing the function of the key barrier mechanism 211. The key secret delivery mechanism 212 consists of the axis 206-3 of the split collar located on the surface of this axis of the two-way thread with multidirectional starts, a slider 212-1 sliding in this thread with one end rigidly fixed in the inner hole of the split collar 203-1 and the other end sliding along the two-way thread of the axis 206-3. The slider 212-1 is made so that, when passing the places of intersection of the thread starts, the slider 212-1 does not switch to the crossing thread start. By moving, for each turn of the key 100, the split collar 206-1 deep into the lock 200 and back, the key secret delivery mechanism 212 delivers the key secret 103 to the secret mechanism 202 inaccessible from the outside, where the key secret 103 interacts with the secret mechanism 202, activating it and opening the lock 200. Being activated when a suitable key secret 103 is at the far dead center, the secret mechanism 202 engages a bolt drive 203 with the sleeve of the keyhole 201, thereby allowing the lock 200 to perform the working stroke.

An embodiment of the proposed implementation of the device may be the driving bracket 206-5 which is driven by a gear system from the bow 101 of the key 100. This bracket 206-5 may transfer a translational movement to the split collar 206-1, while there is no need for a two-way thread on the axis 206-7 of the split collar 206-1.

This method has advantages over the previously used similar methods, since it completely excludes the possibility of external access to the secret mechanism 202 of the lock 200 through the keyhole 201 covered by the fixed septum that serves as the keyhole barrier 207. The technical result of the claimed method is an increase in the lockpicking resistance of the lock, which is achieved by using the keyhole barrier 207.

The fourth essential feature of the present invention is a hitherto unknown method of installing the key barrier 210 separating the parts of the key 100 from each other after they are disassembled.

The sequence of actions carried out when implementing the claimed method is as follows. The key 100 is placed into the keyhole 201 using the proposed method, the key 100 comprising the bow 101, the shank 102, the key secret 103 and the grab 104. The parts of the key 100 are disassemble, and the key barrier mechanism 211 installs the key barrier 210 between the disassembled parts of the key 100.

Strictly obligatory in the claimed method are the following actions: during the working stroke of the lock 200, the key barrier 210 separating the parts of the key 100 is installed between the parts of the key 100.

The rest of the actions according to the fourth feature of the group of inventions are optional. Several variants of the sequence of actions of the method are possible, in which the execution of a number of actions is combined in time.

An implementation example of the claimed method may be the key 100 of the lever tumbler lock 200, which comprises the key secret 103 made in the form of a set of barbs, the grab 104 consisting of the tapered sleeve 103-1 connected to the non-working side of the key secret 103 and the tapered shaft 102-1 of the same tapering, which is made at the end of the shank 102 remote from the bow 101. When such a key 100 is inserted in the lock 200, the key secret 103 falls into the slot of the split collar 206-1 of the docking mechanism. The split collar 206-1 is made coaxially with the axis of rotation of the tapered shaft of the shank. The diameter of the split collar 206-1 is made smaller than the length of the non-working part of the key secret 103. The width and shape of the slot of this split collar 206-1 is made based on the width and shape of the non-working part of the secret key 103. The insertion of the key 100 in the split collar 206-1 and the withdrawal of the key 100 from the split collar 206-1 are limited to a slot of the same width and shape in the split washer 206-2. The split washer 206-2 is unable to rotate around the axis of the tapered shaft 102-1 of the shank 102, from which it is held by the radially directed sliding stud 206-8 of the split collar. The sliding stud 206-8 has one end rigidly fixed in the split washer and passing through a spiral slot in a sleeve of the keyhole 201, and another end placed in a longitudinal keyway slot made on the inner surface of the lock body 205. The split washer 206-2, due to the location of the sliding stud 206-8 in the keyway slot of the lock body 205, is capable of making translational movement along the axis of rotation of the tapered shaft 102-1 of the shank 102 together with the split collar 206-1. Inserting the key secret 103 in the split collar 206-1 and removing the key 100 from the split collar are possible only in one angular position of the split collar 206-1 relative to the split washer 206-2, in which the grab 104 is closed, i.e. the tapered sleeve 103-1 of the key secret is mounted on the tapered shaft 102-1 of the shank. This design of the docking mechanism 206 makes it impossible to extract the individual parts of the key 100 and allows only the fully assembled key 100 to be removed from the lock 200.

The keyhole 201 is made in the form of a sleeve coaxial with the split collar 206-1, and the split collar 206-1 is located in the bore of the keyhole 201. The split collar 206-1 has the possibility of translational movement inside the sleeve of the keyhole 201. The split collar 206-1 also has the ability to rotate jointly with the sleeve of the keyhole 201, receiving it through the sliding insert 206-4. The sliding insert 206-4 has one end rigidly fixed in the keyway hole on the outer surface of the split collar 206-1, and another end sliding in the keyway slot on the inner the surface of the sleeve of the keyhole 201.

Under the action of this sliding insert 206-4, the split collar 206-1 receives a rotational movement, and the split collar 206-1 moves in the longitudinal direction along a fixed two-way spiral thread made on the outer surface of the pivot axis 206-3 of this split collar 206-1. One thread start of the pivot axis 206-3 is made in the left direction, and the second thread start is made in the right direction. The left and right thread starts are connected together at the beginning and at the end and form a bi-directional spatial spiral. When the split collar 206-1 rotates around the pivot axis 206-3 in any direction, the split collar moves to one side in the first half of the revolution and moves to the other side in the second half of the revolution. This movement of the split collar 206-3 resembles that of a piston in a crank mechanism. Drawing this analogy further, it is possible to designate the extreme positions of the split collar 206-1 as near and far dead centers. At the near dead center, the key secret 103 is connected to the shank 102, the grab 104 is closed. At the far dead center, the key secret 103 is delivered to the secret mechanism 202 and activates this mechanism in case of a suitable key.

The pivot axis 206-3 of the split collar 206-1 is rigidly attached at one end to the lock body 205 from the inner side of the lock 200 and enters the split collar 206-1 from its end located on the inner side of the lock 200 and located opposite to the end surface facing the keyhole 201.

When the bow 101 rotates, the shank 102 connected thereto rotates, by its square part, the keyhole 201. The latter transmits this rotation through the sliding insert 206-4 to the split collar 206-1. The non-rotating slot of the split washer 206-2, which is held from rotation by the sliding stud 206-8, overlaps the slot of the split collar 203-1. This overlap prevents the key secret 103 from being extracted from the split collar 206-1. As the bow 101 and the square shank 102 rotate further, the split collar 206-1 receives rotation from the square-bored keyhole 201.

Since the split collar 206-1 receives both a rotational and a translational movement, and the latter, in the case of insertion of the key 100, is directed from the shank 102, this translational movement removes the key secret 103 together with the tapered sleeve 103-1 attached thereto from the tapered shaft 102-1, thereby acting as a puller for bearings. Hence, the rotation of the bow 101 of the key brings the grab 104 to the open state and moves the key secret 103 together with the split collar 206-1 along the spiral thread of the pivot axis 206-3 deep into the lock 200, thereby delivering the key secret 103 to the secret mechanism 202.

The key secret 103 is separated from the shank 102 by the action of the grab 104 and the docking mechanism 206, which allows the keyhole separator 208 and the key barrier mechanism 211 to completely block the keyhole 201, divide the keyhole 201 into the outer keyhole 201-1 and the inner keyhole 201-2 by the keyhole barrier 207, as well as to divide the parts of the key 100 by the key barrier 210. The bracket 206-5 is made in the form of an anchor of a clockwork; while rotating on the bracket axis 206-6 perpendicular to the pivot axis 206-7 of the split collar 206-1, and under the action of the translational movement of the split collar 206-1, one of parts of the bracket 206-5 opens a passage for access of the key secret 103 to the secret mechanism 202, thereby removing the key barrier 210, performing the function of the keyhole separator 208. Another of the parts of the bracket 206-5 closes the passage to the key secret 103 from the side of the keyhole 201 and the shank 102, thereby setting up the keyhole barrier 207, while performing the function of the key barrier mechanism 211.

This method has advantages over previously used similar methods, since it completely excludes the possibility of external access to the secret mechanism 202 of the lock through the keyhole 201 covered by the fixed septum that functions as the barrier 210. The technical result of the claimed method is an increase in the lockpicking resistance of the lock, which is achieved by using the key barrier 210.

Various embodiments of the claimed mechanisms are possible. For example, the grab 104 may be made in the form of a spring-loaded ball contained in the key secret 103 and protruding from the inner surface of the tapered sleeve 103-1 of the key secret and falling into the hole drilled on the surface of the tapered shaft 102-1. The docking mechanism may be made in the form of two gears, one of which may be made on the shank 102 and another has a slot in the shape of the inoperative part of the key secret 103. In the meantime, the docking mechanism 206 may be in the form of a magnet holding the key secret 103 pulled to the shank 102. The key barrier mechanism 211 and the keyhole separator 208 may be made in the form of movable shutters and rockers driven by additional gears.

The fifth essential feature of the invention is a hitherto unknown device—the docking mechanism 206 which disassembles the key 100 into parts.

The design of the claimed device consists of the following essential elements: a key 100 consisting of a bow 101, a shank 102, a key secret 103, a grab 104, the key 100 being configured to be disassembled into parts by the grab 104; a lock 200 consisting of a keyhole 201, a secret mechanism 202, a bolt drive 203, a lock bolt 204, a lock body 205, a docking mechanism 206, a key secret delivery mechanism 212. The rest of the key elements (a keyhole barrier 207, a keyhole separator 208, a lock handle 209; a key barrier 210, a key barrier mechanism 211) are optional. The inclusion of the optional elements in the design of the claimed lock allows one to create various options for the proposed device.

The purpose of the grab 104 is to disassemble and/or assemble the key 100. The purpose of the docking mechanism 206 is to divide the key 100 into parts by the grab 104. The purpose of the key secret delivery mechanism 212 is to deliver the part of the key 100 which is separated from the remaining parts of the key 100 and contains the key secret 103 to the secret mechanism 202. The purpose of the remaining elements of the key 100 and the lock 200 has been described earlier.

The docking mechanism 206 may be made in the form of a cylinder 206-9 with a groove 206-91 having the same shape and dimensions as the key secret 103. The cylinder 206-9 has an axis of rotation parallel to the axis of the keyhole 201. In a static position, the groove 206-91 is connected to the keyhole 201. The key 100 comprising the grab 104 located along the line connecting the key secret 103 and the shank 102 is moved by translational movement into the keyhole 201, while the key secret 103 falls into the groove 206-91. The rotary motion of the bow 101 of the key 100 drives the keyhole 201, it drives the cylinder 206-9 of the docking mechanism 206 through the devices known from the prior art, such as gears or belt drives. The rotation of the cylinder 206-9 overcomes the attractive force of the magnets of the grab 104, and the key secret 103 is separated from the grab 104 and rotates together with the cylinder 206-9. The cylinder 206-9 is in the shape of a glass, the groove 206-91 is located in the wall of the glass. The barbs of the key secret 103 installed in the groove 206-91 protrude into the interior of the cylinder 206-9 from the walls of this cylinder 206-9 and, when rotated, move to the secret mechanism 202 located inside the cylinder 206-9. Further interaction of the key secret 103 and the secret mechanism 202 of the lock occurs in a conventional manner.

With further rotation of the cylinder 206-9, the key secret 103 returns to the grab 104 of the key 100, the magnets of the grab 104 attract the key secret 103, the key secret 103 connects to the shank 102, and the key 100 may be removed from the keyhole 201 in the assembled form.

The key secret 103 in the proposed device should be made of magnetic material, and the magnets of the grab 104 should have a sufficient magnetic strength so that when carrying the key 100, the key secret 103 does not spontaneously separate from the shank 102. The magnets of the grab 104 may be attached to the shank 102 in any conventional manner.

The advantage of the proposed device is the impossibility of accessing the secret mechanism 202 of the lock through the keyhole 201 and the ability to change the key secret 103 to open different locks 200.

In an embodiment of such a docking mechanism, the barbs of the secret keys 103 are placed towards the shank 102. With such an arrangement of the barbs of the key secret 103, it is possible to carry the secret mechanism 202 of the lock out of the cylinder 206-9. In this case, the cylinder 206-9 with its groove 206-91 captures the part of the key secret 103 remote from the grab 104. With further rotation of the cylinder 206-9, the barbs of the key secret 103 protruding from the cylinder 206-9 reach the secret mechanism 202 located outside the cylinder 206-9.

The sixth essential feature of the present invention is a hitherto unknown device—the keyhole separator 208 that disassembles the keyhole 201 into parts.

An implementation example of the claimed device may be a cylinder 206-9, which is equipped with an additional sector 206-92 which closes, when the cylinder 206-9 rotates, the keyhole 201 after separating the key secret 103 from the grab 104. This sector 206-92 has a wedge-shaped shape and pushes the remaining parts of the key 100 in the keyhole 201 outward, then closes the keyhole 201, thereby performing the functions of the keyhole separator 208.

This device has advantages over the previously used counterparts, since it completely excludes the possibility of external access to the secret mechanism 202 of the lock through the keyhole 201, since the key 100 is disassembled by the keyhole separator 208 and the keyhole 201 is closed. The technical result of the claimed device is an increase in the lockpicking resistance of the lock, which is achieved by disassembling the keyhole 201.

The seventh essential feature of the present group of inventions is a hitherto unknown method of providing the separate movement of different parts of the key 100 in the lock 200 after the key 100 is disassembled into the parts.

The sequence of actions carried out when implementing the claimed method is as follows. The key 100 is placed in the keyhole 201 by the proposed method, the key 100 comprising the bow 101, the shank 102, the key secret 103 and the grab 104. The parts of the key 100 are disassembled, and the part of the key 100 with the key secret 103 is moved along a different trajectory than the part of the key 100 that does not comprise the key secret 103.

The following actions are strictly required in the claimed method: the part of the key 100 is moved along a different trajectory than the other part(s) of the key 100.

The rest of the actions according to the seventh feature of the group of inventions are optional. Several variants of the sequence of actions of the claimed method are possible, in which the execution of a number of actions is combined in time.

An implementation example of the claimed method may be the key 100 of the lever lock 200, which comprises the key secret 103 made in the form of a set of barbs, the grab 104 consisting of the tapered sleeve 103-1 connected to the non-working side of the key secret 103 and the tapered shaft 102-1 of the same tapering, which is provided at the end of the shank remote from the bow 101, as described earlier in the previous features of the invention. The key secret 103 separated from the grab 104 rotates around the axis of rotation of the cylinder 206-9, and the shank 102 rotates around the axis of rotation of the keyhole 201.

This method has advantages over previously used similar methods, since it completely excludes the possibility of external access to the secret mechanism 202 of the lock. The technical result of the claimed method is an increase in the lockpicking resistance of the lock 200, which is achieved by using the separate movement of different parts of the key 100.

The eighth essential feature of the present group of inventions is a hitherto unknown method of interacting the key secret 103 separated from the remaining parts of the key 100 with the secret mechanism 202 when this secret mechanism 202 is activated.

The sequence of actions carried out when implementing the claimed method is as follows. The key 100 is placed into the keyhole 201 by using the proposed method, the key 100 comprising the bow 101, the shank 102, the key secret 103 and the grab 104. The parts of the key 100 are disassembled, and the part of the key 100 with the key secret 103 interacts with the secret mechanism 202.

The following actions are strictly obligatory in the claimed method: interaction with the secret mechanism 202 is carried out by the part of the key 100 which is separated from the rest of the key 100 and comprises the key secret 103.

The rest of the actions according to the eighth feature of the group of inventions are optional. Several variants of the sequence of actions of the claimed method are possible, in which the execution of a number of actions is combined in time.

An implementation example of the claimed method may be the key 100 of the lever lock 200, which comprises the lock secret 103 made in the form of a set of barbs, the grab 104 consisting of the tapered sleeve 103-1 connected to the non-working side of the key secret 103 and the tapered shank 102-1 of the same tapering, which is performed at the end of the shank remote from the bow 101, as described earlier in the previous features of the invention. The key secret 103 separated from the grab 104 interacts with the key secret mechanism 201.

This method has advantages over previously used similar methods, since it completely excludes the possibility of external access to the secret mechanism 202 of the lock. The technical result of the claimed method is an increase in the lockpicking resistance of the lock 200, which is achieved by the interaction of only a part of the key 100 with the secret mechanism.

The ninth essential feature of the present group of inventions is a hitherto unknown method of protecting the secret mechanism 202 from external influences, in which: the key 100 is inserted in this keyhole 201; then, the key 100 is disassembled into parts; then, the keyhole 201 is disassembled into parts; then, one part of the keyhole 201 is separated from its other part by the keyhole barrier 207; then, the parts of the key 100 are separated by the key barrier 211; then, after the keyhole 201 is divided by the key barrier 207 and the parts of the key 200 are separated from each other by the key barrier 211, the key secret 103 is delivered to the secret mechanism 202 of the lock which is inaccessible from the outside.

The sequence of actions carried out when implementing the claimed method is as follows. The key 100 is placed into the keyhole 201 by using the proposed method, the key 100 comprising the bow 101, the shank 102, the key secret 103 and the grab 104. The parts of the key 100 are disassembled, and the keyhole 201 is separated by the keyhole barrier 207, while the parts of the key 100 are separated by the key barrier 211.

The following actions are strictly obligatory in the claimed method: the keyhole 201 is separated by the keyhole barrier 207, and/or parts of the key 100 are separated by the key barrier 211.

The rest of the actions according to the ninth feature of the group of inventions are optional. Several variants of the sequence of actions of the claimed method are possible, in which the execution of a number of actions is combined in time.

An implementation example of the claimed method may be the key 100 of the lever tumbler lock 200, which comprises the key secret 103 made in the form of a set of barbs and the grab 104, as described earlier in the previous features of the group of inventions. The sector 206-92 closes the keyhole 201 and serves as the keyhole barrier 207. The end of the cylinder 206-9 separates the parts of the key 100 from each other and serves as the key barrier 211. Being separated from the grab 104, the key secret 103 interacts with the secret mechanism 202.

This method has advantages over previously used similar methods, since it completely excludes the possibility of external access to the secret mechanism 202 of the lock. The technical result of the claimed method is an increase in the lockpicking resistance of the lock 200, which is achieved by disassembling the keyhole 201 into parts by the keyhole barrier 207 and disassembling different parts of the key 100 from each other by the key barrier 211.

The tenth essential feature of the present group of inventions is a method known from the prior art, which is used for delivering the key secret 103 to the secret mechanism 202. In this method, the delivery of the key secret 103 to the secret mechanism 202 via the keyhole 201 is performed not by the shank 102 but by an additional lock control, e.g., the lock handle 209. The additional lock control, e.g., the lock handle 210, is excluded from this known method, and its functions are performed by the bow 101 separated from the key secret 103.

In known methods, the key 100 is completely placed in the keyhole 201, which is inconvenient from the point of view of ergonomics, especially in the case of removing the key 100 from the keyhole 201. Inserting the entire key 100 in the keyhole 201 leads to the need to increase the dimensions of the keyhole 201, as well as to the use of strange, unusual keys of a strange shape. In the present group of inventions, the part of the key 100 with the key secret 103 is delivered to the secret mechanism 202 by the docking mechanism 206, so that the part of the key 100 with the bow 101 remaining outside the lock may be comfortably held in a human hand, which is a common, traditional way of opening the lock.

The sequence of actions carried out when implementing the claimed method is as follows. The key 100 is placed into the keyhole 201 by using the proposed method, the key 100 comprising the bow 101, the shank 102, the key secret 103 and the grab 104. The parts of the key 100 are disassembled by the docking mechanism 206, and the key secret 103 is delivered to the secret mechanism 202 by the key secret delivery mechanism 212 driven by the bow 101.

The simultaneous presence of all the following actions performed in an arbitrary sequence is strictly mandatory in the claimed method: the part of the key 100 comprising the key secret 103 is separated from the remaining parts of the key 100, and the key secret 103 is delivered to the secret mechanism 202 by the key secret delivery mechanism 212 driven by the bow 101.

The rest of the actions according to the tenth feature of the group of inventions are optional. Several variants of the sequence of actions of the claimed method are possible, in which the execution of a number of actions is combined in time.

An implementation example of the claimed method may be the key 100 of the lever tumbler lock 200, which comprises the key secret 103 made in the form of a set of barbs and the grab 104, as described earlier in the previous features of the group of inventions. The sector 206-92 closes the keyhole 201 and serves as the keyhole barrier 207. The cylinder 206-9 driven in rotation by the bow 101 delivers the key secret 103 separated from the grab 104 to the secret mechanism 202, thereby acting as the key secret delivery mechanism 212.

This method has advantages over previously used similar methods, since it completely excludes the possibility of external access to the secret mechanism 202 of the lock. The technical result of the claimed method is an increase in the lockpicking resistance of the lock 200, which is achieved by delivering the key secret 103 separated from the rest of the key through the key secret delivery mechanism 212 driven by the bow 101.

The eleventh essential feature of the present group of inventions is a device known from the prior art—the grab 104 which disassembles the key 100 into parts for easy storage and transportation. In the present group of inventions, this grab 104 is used for a new, hitherto unknown application, i.e. not only for disassembling the key 100 in order to store and reduce the size of the key 100 and assemble the key 100 before its application (insertion in the lock 200), but also for disassembling and assembling the key 100 when it is in the lock 200.

The design of the claimed device consists of the following essential elements: the key 100 consisting of the bow 101, the shank 102, the secret 103, the grab 104, the key 100 configured to be disassembled into parts by the grab 104; the lock 200 consisting of the keyhole 201, the secret mechanism 202, the bolt drive 203, the bolt 204, the lock body 205, the docking mechanism 206, the key secret delivery mechanism 212. The rest of the key elements (the keyhole barrier 207, the keyhole separator 208, the lock handle 209; the key barrier 210, the key barrier mechanism 211) are optional. The inclusion of the optional elements in the design of the claimed lock allows one to create various options for the proposed device.

The purpose of the grab 104 is to disassemble and/or assemble the key 100. The purpose of the docking mechanism 206 is to disassemble the key 100 into parts at the grab 104. The purpose of the key secret delivery mechanism 212 is to deliver the part of the key 100 comprising the key secret 103, which is separated from the remaining parts of the key 100, to the secret mechanism 202. The purpose of the remaining elements of the key 100 and the lock 200 has been described earlier.

The grab 104 may be placed along the line connecting the key secret 103 and the shank 102 and is made in the form of magnets fixed in the shank 102. The key secret 103 in the proposed method should be made of magnetic material, and the magnets of the grab 104 should have a sufficient magnetic strength so that, when the key 100 is carried, the key secret 103 does not spontaneously separate from the shank 102. The magnets of the grab 104 may be attached to the shank 102 in any known manner.

The advantage of the proposed method is the impossibility of access to the secret mechanism 202 of the lock through the keyhole 201 and the ability to change the key secret 103 to open different locks 200.

The technical result of the claimed method is an increase in the lockpicking of the lock 200, which is achieved by disassembling the key 100 into parts by the grab 104 during the working stroke of the lock 200.

The twelfth essential feature of the present group of inventions is a hitherto unknown method of using the grab 104 both for the purpose of the known method for disassembling the key into parts when carrying the key, and for the purpose of a hitherto unknown method for using different key secrets 103 with the same remaining parts of the lock 200 (for example, the shank 102 and the bow 101).

The sequence of actions carried out when implementing the claimed method is as follows. Different key secrets 103 for different locks are attached to the key 100 comprising the bow 101, the shank 102, and the grab 104 located outside the lock 200. The key secrets 103 are detached to reduce the size of the key 100. When the key 100 is in the lock 200, the parts of the key 100 are disassembled by the docking mechanism 206.

The presence of all the following actions is strictly obligatory in the claimed method: disassembling and assembling the key 100 outside the lock, disassembling and assembling the key 100 inside the lock.

The rest of the actions according to the twelfth feature of the group of inventions are optional. Several variants of the sequence of actions of the claimed method are possible, in which the execution of a number of actions is combined in time.

An implementation example of the claimed method may be the key 100 of the lever tumbler lock 200, which comprises the grab 104, several key secrets 103 for different locks 22 which are made in the form of a set of barbs, as described earlier in the previous features of the invention.

This method has advantages over previously used similar methods, since it completely excludes the possibility of external access to the secret mechanism 202 of the lock, reduces the weight of the dimensions of a bunch of several keys 100. The technical result of the claimed method is an increase in the lockpicking resistance of the lock 200, which is achieved by delivering the key secret 103 separated from the rest of the key by the key secret delivery mechanism 212 driven by the bow 101, as well as a decrease in the weight and dimensions of the bunch of keys.

The important thirteenth feature of the group of inventions is a stopper 213 known from the prior art, which prevents, in the present group of inventions, the removal of not the entire key 100 but only a part and or parts of the disassembled key 100 from the keyhole 201 during the disassembled state of the key 100.

The design of the claimed device consists of the following essential elements: the key 100 consisting of the bow 101, the shank 102, a radial stud 102-1 protruding beyond the shank 102, the key secret 103, and the grab 104, the key 100 being configured to be disassembled into parts by the grab 104; the lock 200 consisting of the keyhole 201, a rocker 214, the docking mechanism 206. The rest of the key and lock elements are optional. The inclusion of the optional elements in the design of the claimed lock allows one to create various options for the proposed device.

The part of the key 100 with the bow 101 protruding outward from the keyhole 201 is blocked from being removed from the keyhole 201 by the stopper 213 consisting of the stud 102-1 and the rocker 214. The stud 102-1 is placed on the shank 102, and the rocker 214 with slots for the stud 102-1 is placed in the keyhole 201 and allows the key 100 to be removed from the keyhole 201 only in a certain position of the key 100 relative to the rocker 214, which corresponds to the connected state of the key 100.

The purpose of the stopper 214 is to prevent a part of the key 100 from being removed from the lock 200.

The technical result of the claimed feature of the group of inventions consists in preventing the removal of the part of the key 100 from the lock 200.

An important fourteenth feature of the present group of inventions is the grab 104 known from the prior art. In contrast to the prototype in which two parts of the grab 104 are attached to the parts of the key 100, the grab 104 in the present group of inventions may be completely separated from the remaining parts of the key 100, thereby forming another part of the key 100 and allowing this grab 104 to be placed in the keyhole barrier 207 and/or the key barrier 210.

The design of the claimed device consists of the following essential elements: the key 100 consisting of the bow 101, the shank 102, the key secret 103, and the grab 104, the key being configured to be disassembled into parts by a grab 104; the lock 200 consisting of the keyhole 201, the secret mechanism 202, the bolt drive 203, the bolt 204, the lock body 205, the docking mechanism 206, the keyhole barrier 207, the key barrier 210, the key secret delivery mechanism 212. The rest of the key elements (the keyhole separator 208, the lock handle 209, the key barrier mechanism 211) are optional. The inclusion of the optional elements in the design of the claimed lock allows one to create various options for the proposed device.

The purpose of the grab 104 is to disassemble and/or assemble the key 100. To simplify the design of the key 100, the grab 104 may be made in the form of a cylindrical magnet connecting the two parts of the shank 102. By implementing the keyhole barrier 207 in the form of a washer with a shaped hole corresponding to the shape of the key 100 and with a thickness equal to a thickness of the magnet of the grab 104, it is possible to place the magnet of the grab 104 in the keyhole barrier 207. This solution will allow for easy separation of the parts of the key 100 and simplify the docking mechanism 206. The purpose and design of the remaining elements of the key 100 and the lock 200 have been described earlier.

The grab 104 may be positioned along the junction line of the shank 102, and the key secret 103 and the part of the shank 102 attached thereto are separated from the rest of the shank 102 connected to the bow 101 of the lock. The grab 104 is made in the form of a magnet having a cross-section of the shank 102 and fixed in the shank 102 only by the force of magnetic attraction. The shank 102 or part of the shank 102 in the proposed device should be made of a material that is attracted to the magnet, and the magnets of the grab 104 should have a sufficient magnetic force so that, when the key 100 is carried, the parts of the shank 102 do not spontaneously separate from the grab 104.

The advantage of the proposed method is an impossibility of access to the secret mechanism 202 of the lock through the keyhole 201 and the ability to change the key secret 103 to open different locks 200.

The technical result of the claimed method is an increase in the lockpicking resistance of the lock 200, which is achieved by disassembling the key 100 into parts by the grab 104 during the working stroke of the lock 200, while simplifying the design of the grab 104 and the docking mechanism 203 which can be combined with the keyhole barrier 207.

The present group of inventions meets all the necessary and sufficient patentability criteria: industrial applicability, novelty, inventive step. Let us consider the compliance of each feature of the present group of inventions with these criteria.

In order for the solution to be industrially applicable, it is necessary that it can be implemented in practice. It is necessary that the device can perform its function and the method can be carried out. To this end, the text of the application for the invention should describe the means and methods by which the solution can be implemented in the form as described in the claims, taking into account the knowledge of a person skilled in the art.

In order for the invention to be new, it is necessary that it is unknown earlier from the information sources published in the world.

An invention is not recognized as new if objects are known from the prior art, which have all the features described in an independent claim.

In order for an invention to involve an inventive step, it is necessary that it does not explicitly follow from the prior art, i.e. was unobvious to a skilled person given information from several sources of information. When analyzing the obviousness of the invention, the closest analogue (prototype) of the same purpose is first identified and the differences between the invention and the prototype are determined, then additional sources of information from which these differences are known are identified. If differences are identified and allow achieving the same result as in the claimed invention, the claimed invention is obvious from the prior art and does not have an inventive step.

The first feature of the present invention is an action of disassembling the key 100 into parts during the working stroke of the lock 200. The industrial applicability of this feature follows from the state of the art, since there are robots that independently perform assembly and disassembly of complex devices, using a computer vision system to perform such work. There are also simpler ways to disconnect and connect devices. For example, several steel shanks may be connected by cylindrical magnets of a suitable diameter, and by installing such a device in a sleeve with clamps, alternately securing the necessary magnets and the required shanks with clamps, and moving these clamps in a desired direction, one can perform the operations of disconnecting and connecting the shanks.

The novelty of the first feature of the group of inventions is proved by the conducted patent search and analysis of the prior art. In the prior art, there are keys 100 assembled before being inserted in the lock 200, but there is no information about keys that are disassembled and assembled during the working stroke of the lock 200, i.e. inside the lock 200.

The result of using the dismountable key 100 in the present group of inventions is an impossibility of external access to the secret mechanism 202 of the lock, which is achieved by simple and available methods familiar to humans, without having to use additional devices for moving the key 100.

The inventive step proves that the prototype and analogues of the present invention have no key 100 which is disassembled during the working stroke of the lock 200. The difference between the analogue and the proposed invention lies in the fact that the non-assembled key 100 of the prototype is completely inserted in the keyhole 201, which requires the lock to have an additional device for further moving the key 100. After a person inserts the non-assembled key 100 in the keyhole 201, s/he is forced to release the bow of this key and, by acting on another lock control, move this non-assembled key further to the secret mechanism 202. For such complex and unusual manipulations, it is necessary to use both hands, and these manipulations are not visually controlled, since both the prototype and the analogues propose to install the non-assembled key in the lock from below, placing it under the lock handle. Only the dismountable key 100 may provide the claimed result in simple and familiar ways—the complete impossibility of access from the outside to the secret mechanism 202 of the lock, thereby proving the inventive step which cannot be provided by other methods.

All other methods make it difficult to access the secret mechanism of the lock, but they cannot ensure this inaccessibility in simple and familiar ways. In the present group of inventions, the dismountable key 100 is inserted in the keyhole 201, rotated by the bow 101, and as a result of this movement, the key secret 103 is separated from the shank 102 and the bow 101. The bow 101 remains in human hands. The locking mechanism 206 prevents accidental or deliberate removal of the bow 101 and/or the shank 102 of the key when the key 100 is disassembled. A person continues to rotate the bow 101, and the key secret 103 separately from the bow 101 is moved by the docking mechanism 206 to the secret mechanism 202 completely inaccessible from the outside. Using the locking mechanism 300 with the key 100 and the lock 200 which are made according to the present group of inventions, the person will not notice any difference compared to using a conventional key and a conventional lock. This method of opening and closing the lock using the dismountable key 100 is no different from the human habitual method of opening the lock with a conventional non-assembled key. However, the non-assembled key with the bow that remains outside the lock during its operation, in principle, cannot ensure the complete inaccessibility of the secret mechanism 202 from the outside, which reduces the lockpicking resistance of the lock 200. The fundamental inaccessibility of the secret mechanism 202 of the lock from the outside is achieved in the present group of inventions without changing the way of opening and closing the lock, which is familiar to a person, i.e. by disassembling the key into parts during the operation of the lock. The difference between the analogue and the present group of inventions consists in the use of the non-assembled key in the analogue, which does not allow achieving the same result as in the present group of inventions. Therefore, this first feature is unobvious from the prior art and involves an inventive step.

The second essential feature of the invention is a hitherto unknown effect of dividing the keyhole 201 into parts during the working stroke of the lock 200.

The industrial applicability of the second feature of the present invention follows from the prior art, since keyhole separation devices are represented by cutoff plates, ball valves. There are electric drives for cutoff plates and valves that independently divide a channel into parts and combine the channel parts.

The novelty of the second feature of the group of inventions is proved by the conducted patent search and analysis of the prior art. In the prior art, there are devices that complicate access to the keyhole 201, proposing to make keyhole curved in order to pass a key made of a special shape memory alloy through it. It is proposed to perform this keyhole with the reverse side of the lock, but there is no information about dividing the keyhole 201 into parts during the working stroke of the lock.

The result of using the divided keyhole 201 in the present group of inventions is a complete impossibility of external access to the secret mechanism 202 of the lock. The claimed result follows from the fact of dividing the keyhole 201, since that part of the keyhole 201 that delivers the key secret 103 to the secret mechanism 202 of the lock moves along with the key secret 103, but separately from that part of the keyhole 201, in which the shank 102 remains with the bow 101 attached thereto.

The inventive step proves that the prototype and analogues of the present group of inventions have no separation of the keyhole 201 during the working stroke of the lock. The difference of the analogues and the prototype from the present group of inventions lies in the fact that access to the secret mechanism is difficult in the analogues and the prototype, while such access is impossible in the present group of inventions. It is the difference that does not allow the analogues and the prototype to achieve the same result as in the present group of inventions. Therefore, the second feature is unobvious from the prior art and involves the inventive step.

The third essential feature of the present group of inventions is the presence of the hitherto unknown keyhole barrier 207 dividing the keyhole 201 into parts during the working stroke of the lock 200.

The industrial applicability of the third feature of the invention follows from the prior art, since devices blocking movement along a channel are represented by cutoff plates, ball valves. There are mechanical and electrical drives for cutoff plates and valves which independently perform the installation and removal of barriers in the channel.

The novelty of the third feature of the group of inventions is proved by the conducted patent search and analysis of the prior art. In the prior art, there are devices partially blocking access to the keyhole 201, proposing to make the keyhole 201 with a complex shape and with narrow slot-like grooves to pass the key 100 of a complex shape therethrough, but there is no information about the complete blocking of the keyhole 201 during the working stroke of the lock.

The result of using the keyhole barrier 207 installed in the keyhole 201 in the present group of inventions is a complete impossibility of external access to the secret mechanism 202 of the lock. The stated result follows from the fact of blocking the access of any items through the keyhole 201 to the secret mechanism 202 of the lock, since the access to that part of the keyhole 201 that delivers the key secret 103 to the secret mechanism 202 of the lock is completely blocked by the keyhole barrier 207.

The inventive step proves that the prototype and analogues of the present group of inventions have no barriers installed in the keyhole 201 during the working stroke of the lock. The difference of the prototype and analogues from the present group of inventions lies in the fact that access to the secret mechanism is difficult in the prototype and analogues, while such access is impossible in the present group of inventions. It is the difference that does not allow the prototype to achieve the same result as in the present group of inventions. Therefore, the third feature is unobvious from the prior art and involves the inventive step.

The fourth essential feature of the present group of inventions is the presence of the hitherto unknown key barrier 210 which separates the parts of the key 100 from each other after their disassemble.

The industrial applicability of the fourth feature of the group of inventions follows from the prior art, since means separating device parts after their dissemble are represented, for example, by: a revolver cylinder separating a sleeve from a bullet that is, after shooting, in a barrel bore; collet chucks of a counter spindle of a lathe, which move a bar after its cutting. There are mechanical and electrical drives of these devices, which independently perform the installation and removal of the key barriers 210 between the disassembled parts of the key 100.

The novelty of the fourth feature of the group of inventions is proved by the conducted patent search and analysis of the prior art. In the prior art, there is no information about the installation of the key barriers 210 between the disassembled parts of the key 100 during the working stroke of the lock.

The result of using the key barriers 210 installed between the disassembled parts of the key 100 in the present group of inventions is the complete impossibility of external access to the secret mechanism 202 of the lock. The claimed result follows from the fact of blocking access of any objects to the key secret 103 and to the secret mechanism 202 of the lock, since the access to the key secret 103 and the secret mechanism 202 of the lock is completely blocked by the key barrier 210.

The inventive step proves that the prototype and analogues of the present group of inventions do not have barriers installed between the parts of the key 100 during the working stroke of the lock. The difference of the prototype and analogues from the present group of inventions lies in the fact that access to the secret mechanism is difficult in the prototype and analogues, while such access is impossible in the present group of inventions. It is the difference that does not allow the prototype to achieve the same result as in the present group of inventions. Therefore, the fourth feature is unobvious from the prior art and involves the inventive step.

The fifth essential feature of the present group of inventions is the hitherto unknown presence of the docking mechanism 206 disassembling the key 100 into parts in the lock 200.

The industrial applicability of this feature follows from the prior art, since there are robots that independently perform assembly and disassembly of complex devices and use a computer vision system to perform such work. There are also simpler ways to disconnect and connect devices. For example, several steel shanks can be connected cylindrical magnets of a suitable diameter, and by installing such a device in a sleeve with clamps, alternately fixing the necessary magnets and the necessary shanks with the clamps, and moving these clamps in a desired direction, one can perform the operations of disconnecting and connecting the shanks. These prior art devices prove that it is possible to manufacture the docking mechanism 206 to disassemble and/or assemble the key 100.

The novelty of the fifth feature of the present group of inventions is proved by the patent search and analysis of the state of the art. In the prior art, there is no information about mechanisms that assemble and disassemble keys during the working stroke inside the lock.

The result of using the docking mechanism 206 in the present group of inventions is the impossibility of external access to the secret mechanism 202 of the lock, which is achieved by simple and accessible methods familiar to a person, without having to use additional devices for moving the key 100.

The inventive step proves that the prototype and analogues of the present group of inventions do not have such a docking mechanism 206 disassembling the key 100 during the working stroke of the lock. The difference between the analogue and the present group of inventions lies in the fact that the non-assemble key of the analogue is completely inserted in the keyhole 201, which requires the lock to have an additional device for further movement of the key 100. After a person places the non-assembled key 100 into the keyhole 201, s/he is forced to release the bow of this key and, by acting on another lock control, move this non-assembled key further to the secret mechanism 202. For such complex and unusual manipulations, it is necessary to use both hands, and these manipulations are not visually controlled, since both the prototype and the analogues propose to insert the non-assembled key in the lock from below, placing it under the lock handle. Only the docking mechanism 206 disassembling the key 100 into parts may provide the claimed result in simple and familiar ways—i.e. the complete impossibility of external access to the secret mechanism 202 of the lock, thereby proving the inventive step of the present group of inventions, which cannot be provided by other methods.

All other methods make it difficult to access the secret mechanism of the lock, but they cannot provide this inaccessibility in simple and familiar ways. In the present group of inventions, the dismountable key 100 is inserted in the keyhole 201, turned by the bow 101, and as a result of this movement, the key secret 103 is separated from the shank 102 and the bow 101, and the bow 101 remains in human hands.

The docking mechanism 206 proposed in the fifth feature of the group of inventions disassembles the key 100 into parts and assembles the key 100 into a single whole from the parts of the key 100 during the working stroke of the lock 200, prevents accidental or deliberate removal of the bow 101 and/or the shank 102 of the key when the key 100 is disassembled. The person continues to rotate the bow 101, and the key secret 103 separately from the bow 101 is moved by the docking mechanism 206 to the secret mechanism 202 completely inaccessible from the outside. Using the locking mechanism 300 with the key 100 and the lock 200 made according to the present group of inventions, the person will not notice any difference compared to using a conventional key and a conventional lock. This method of opening and closing the lock using the dismountable key 100 is no different from the human habitual method of opening the lock with a conventional non-assembled key. However, the non-assembled key with the bow that remains outside the lock during its operation, in principle, cannot ensure the complete inaccessibility of the secret mechanism 202 from the outside, which reduces the lockpicking resistance of the lock 200.

The fundamental inaccessibility of the secret mechanism 202 of the lock from the outside is achieved in the claimed feature of the group of inventions without changing the method of opening and closing the lock, which is familiar to a person, precisely due to the operation of the docking mechanism 206 dividing the key 100 into parts during the working stroke of the lock 200. The differences between the analogue and the proposed invention consist in the use of the non-assembled key in the analogue which does not allow using the docking mechanism 206 and achieving the same result as in the present group of inventions. Therefore, the fifth feature of the group of inventions is unobvious from the prior art and involves the inventive step.

The sixth essential feature of the group of inventions is the presence of the hitherto unknown keyhole separator 208 in the lock 200, which disassembles the keyhole 201 into parts.

The industrial applicability of this feature follows from the prior art, since there are robots that independently perform assembly and disassembly of complex devices and use a computer vision system for such work. There are also simpler ways to disconnect and connect a channel, such as cutoff plates and ball valves, with which it is possible to perform the operations of disconnecting and connecting the channel. These prior art devices prove that it is possible to manufacture the keyhole separator 208 that disassembles and/or assembles the keyhole 201.

The novelty of the sixth feature of the group of inventions is proved by the conducted patent search and analysis of the prior art. In the prior art, there is no information about such mechanisms assembling and disassembling the keyhole into parts during the working stroke of the lock.

The result of using the keyhole separator 208 in the present group of inventions is the impossibility of external access to the secret mechanism 202 of the lock, which is achieved by simple and accessible methods familiar to humans, without having to use additional devices for moving the key 100.

The inventive step proves that the prototype and analogues of the present group of inventions have no keyhole separator 208 disassembling the keyhole 201 during the working stroke of the lock. The difference between the analogue and the present group of inventions lies in the fact that the non-assembled key of the prototype is completely inserted in the keyhole 201, which requires the lock to have an additional device for further movement of the key 100. After a person places the non-assembled key 100 into the keyhole 201, s/he is forced to release the bow of this key and, by acting on another lock control, move this non-assembled key further to the secret mechanism 202. For such complex and unusual manipulations, it is necessary to use both hands, these manipulations are not visually controlled, since both the prototype and the analogues propose to install the non-assembled key in the lock from below, placing it under the lock handle. Only the keyhole separator 208 disassembling the keyhole 201 into parts can provide the claimed result in simple and familiar ways—the complete impossibility of external access to the secret mechanism 202 of the loc, thereby proving the inventive step of the present group of inventions, which cannot be provided by other methods.

All other methods make it difficult to access the secret mechanism of the lock, but they cannot provide this inaccessibility in simple and familiar ways. In the present group of inventions, the dismountable key 100 is inserted in the keyhole 201, turned by the bow 101, and as a result of this movement, the key secret 103 is separated from the shank 102 and the bow 101, while the bow 101 remains in human hands.

The keyhole separator 208 according to the sixth feature of the group of inventions disassembles the keyhole 201 into parts and assembles it into a single whole. Using the locking mechanism 300 with the key 100 and the lock 200 made according to the present group of inventions, a person will not notice any difference compared to using a conventional key and a conventional lock. This method of opening and closing the lock using the dismountable key 100 is no different from the human habitual method of opening the lock with a conventional non-assembled key. However, the non-assembled key with the bow that remains outside the lock during its operation, in principle, cannot ensure the complete inaccessibility of the secret mechanism 202 from outside, which reduces the lockpicking resistance of the lock 200. The fundamental inaccessibility of the secret mechanism 202 of the lock from the outside is achieved in the claimed feature of the group of inventions without changing the human habitual method of opening and closing the lock, precisely due to the operation of the keyhole separator 208 which divides the keyhole 201 into parts during the working stroke of the lock 200. The differences between the prototype and the proposed invention consist in the use of the non-assembled key in the prototype, which does not allow using the keyhole separator 208 and achieving the same result as in the present group of inventions. Therefore, the sixth feature of the group of inventions is unobvious from the prior art and involves the inventive step.

The seventh essential feature of the group of inventions is the hitherto unknown possibility of separate movement of different parts of the key 100 in the lock 200 after the key 100 is disassembled into parts.

The industrial applicability of this feature follows from the state of the art, since there are robots that independently perform the movement of various elements and parts of mechanisms to the place where complex devices are assembled and disassembled, and use a computer vision system for such work. There are also simpler ways of organizing the separate movement of disassembled parts, such as a spindle and counter spindle of a lathe, with which it is possible to perform separate motion operations of the disassembled parts of the key 100. These prior art devices prove that it is possible to manufacture a mechanism for separately moving different parts of the key 100.

The novelty of the seventh feature of the invention is proved by the conducted patent search and analysis of the prior art. In the prior art, there is no information about such mechanisms performing the separate movement of the parts of the key 100 during the working stroke of the lock 200.

The result of using the separate movement of the parts of the disassembled key 100 in the present group of inventions is the inaccessibility of the secret mechanism 202 of the lock from the outside, which is achieved by simple and accessible methods familiar to a person, without having to use additional devices for moving the key 100.

The inventive step proves that the prototype of the present group of inventions does not use the separate movement of the parts of the disassembled key 100 during the working stroke of the lock. The difference between the analogue and the proposed invention lies in the fact that the non-assembled key in the analogue is completely inserted in the keyhole 201, which requires the lock to have an additional device for performing further movement of the key 100. Only the separate movement of the parts of the disassembled key 100 can provide the claimed result in simple and familiar ways—the complete inaccessibility of the secret mechanism 202 of the lock from the outside, thereby proving the inventive step of the group of inventions, which cannot be provided by other methods. All other methods make it difficult to access the secret mechanism of the lock, but they cannot provide this inaccessibility in simple and familiar ways.

As proposed in the seventh feature of the group of inventions, the separate movement of the parts of the disassembled key 100 ensures that the secret mechanism 202 of the lock is fundamentally inaccessible from the outside, which is achieved in the claimed feature of the group of inventions without changing the way of opening and closing the lock that is familiar to humans. The differences between the analogue and the present group of inventions consist in the use of the non-assembled key in the analogue, which does not allow using the separate movement of the parts of the disassembled key 100 and achieving the same result as in the present group of inventions. Therefore, this feature of the group of inventions is unobvious from the prior art and involves the inventive step.

The eighth essential feature of the present group of inventions is the hitherto unknown interaction of the key secret 103 separated from the remaining parts of the key 100 with the secret mechanism 202 of the lock when this secret mechanism 202 is activated.

The industrial applicability of this feature follows from the prior art, since there are robots that independently perform the interaction of various elements and parts of mechanisms and use a computer vision system for such work. There are also simpler ways of interaction between various parts and elements, such as automatic tool changers on milling machines that may perform operations similar to the interaction of the disassembled parts of the key 100 with the secret mechanism 202. These prior art devices prove that the disassembled parts of the key 100, in particular, the key secret 103, can interact with the secret mechanism 202 of the lock.

The novelty of the eighth feature of the group of inventions is proved by the conducted patent search and analysis of the prior art. In the prior art, there is no information about such mechanisms performing the interaction of any disassembled parts of the key 100 with any mechanisms of the lock 200 during the working stroke of the lock 200.

The result of the interaction of the separated key secret 103 with the secret mechanism 202 of the lock in the present group of inventions is the inaccessibility of the secret mechanism 202 of the lock from the outside, which is achieved by simple and accessible methods familiar to humans, without having to use additional devices for moving the key 100.

The inventive step proves that the prototype and analogues of the present group of inventions do not provide the interaction of the separated key secret 103 with the secret mechanism 202 of the lock during the working stroke of the lock. The difference between the analogue and the proposed invention lies in the fact that the non-assembled key in the analogue is completely inserted in the keyhole 201, which requires the lock to have an additional device for performing further movement of the key 100. Only the interaction of the separated key secret 103 with the secret mechanism 202 of the lock can provide the claimed result in simple and familiar ways—the complete inaccessibility of the secret mechanism 202 of the lock from the outside, thereby proving the inventive step of the present group of inventions, which cannot be provided by other methods. All other methods make it difficult to access the secret mechanism of the lock, but they cannot provide this inaccessibility in simple and familiar ways.

As proposed in the eighth feature of the group of inventions, the interaction of the separated key secret 103 with the secret mechanism 202 of the lock ensures that the secret mechanism 202 of the lock is fundamentally inaccessible from the outside, which is achieved in the claimed feature of the group of inventions without changing the usual human method of opening and closing the lock. The differences between the prototype and the present group of inventions lie in the use of the non-assembled key in the prototype, which does not allow the disassembled parts of the key 100 to interact, in particular, the separated key secret 103 with the secret mechanism 202 of the lock, which does not allow the prototype and analogues to achieve the same result as in the present group of inventions. Therefore, this feature of the group of inventions is unobvious from the prior art and involves the inventive step.

The ninth essential feature of the applied invention is a hitherto unknown method of protecting the secret mechanism 202 from external influences. In this method, after the known installation of the key 100 in the keyhole 201, this key 100 is disassembled into parts. Then, the keyhole 201 is disassembled into parts. Then, one part of the keyhole 201 is separated from its other part by the grab 104. Then, the parts of the key 100 are separated by the key barrier 110. After the keyhole 201 is disassembled by the key barrier 210, the key secret 103 is delivered to the secret mechanism 202 inaccessible from the outside.

The industrial applicability of this feature follows from the previously mentioned evidence of the industrial applicability of features 1 to 8. The novelty of the ninth feature of the invention is proved by the conducted patent search and analysis of the prior art. In the prior art, there is no information about such a method. The result of the proposed method is the inaccessibility of the secret mechanism 202 of the lock from the outside, which is achieved by simple and affordable methods familiar to a person, without having to use additional devices for moving the key 100.

The inventive step proves that the prototype and analogues of the present group of inventions do not provide any of the above actions. The difference of the analogues and the prototype from the present group of inventions lies in the fact that the non-assembled key in the prototype is completely inserted in the keyhole 201, which requires the lock to have an additional device for performing further movement of the key 100. Only the implementation of the actions declared in the ninth feature of the group of inventions can provide the claimed result in simple and familiar ways—the complete inaccessibility of the secret mechanism 202 of the lock from the outside, thereby proving the inventive step of the present group of inventions, which cannot be provided by other methods. All other actions hinder access to the secret mechanism of the lock but cannot provide this inaccessibility in simple and familiar ways for a person.

The previously unknown set of actions proposed in the ninth feature of the group of inventions ensures that the secret mechanism 202 of the lock is fundamentally inaccessible from the outside, which is achieved in the claimed feature of the group of inventions without changing the way of opening and closing the lock that is familiar to humans. The differences between the analogue and the present group of inventions consist in the use of the non-assembled key in the analogue, which does not allow the opposed lock to perform the declared set of actions. This does not allow the prototype and analogues to achieve the same result as in the claimed invention. Therefore, this feature of the group of inventions is unobvious from the prior art and involves the inventive step.

The tenth essential feature of the present group of inventions is a method known from the prior art, which is used for delivering the key secret 103 to the secret mechanism 202 of the lock. In this method, the delivery of the key secret 103 to the secret mechanism 202 of the lock via the keyhole 201 is performed not by the shank 102 but by another lock element, for example, a door handle. However, in the known methods, the key 100 is completely inserted in the keyhole 201, which is inconvenient from the point of view of ergonomics, especially in the case of removing the key 100 from the keyhole 201, as well as leads to the need to increase the dimensions of the keyhole 201 and use unusual, uncommon keys. In the present group of inventions, the part of the key 100 with the key secret 103 is delivered to the secret mechanism 202 of the lock by means of the docking mechanism 206 such that the part of the key 100 with the bow 101 remaining outside the lock can be comfortably held in a human hand, which is a common, traditional way of opening the lock.

The industrial applicability of this feature follows from the prior art, since there are robots that independently perform assembly and disassembly of complex devices and use a computer vision system to for such work. There are also simpler ways to disassemble and assemble devices, for example, several steel shanks can be connected by cylindrical magnets of a suitable diameter; and by installing such a device in a sleeve with clamps, alternately securing the necessary magnets and the required shanks with the clamps, and moving these clamps in a desired direction, on can perform the operations of disassembling and assembling the shanks.

The novelty of the tenth feature of the invention is proved by the conducted patent search and analysis of the prior art, in which there is no information about the keys that move inside the lock in a disassembled state.

The result of using the dismountable key 100 in the present group of inventions is the inaccessibility of the secret mechanism 202 of the lock from the outside, which is achieved by simple and accessible methods familiar to humans, without having to use additional devices for moving the key 100.

The inventive step proves that the prototype and analogues of the present group of inventions have no key 100 which is disassembled during the working stroke of the lock. The difference between the analogue and the present group of inventions lies in the fact that the non-assembled key in the prototype is completely inserted in the keyhole 201, which requires the lock to have an additional device for performing further movement of the key 100. After a person inserts the non-assembled key 100 in the keyhole 201, s/he is forced to release the bow of this key and, by acting on another lock control, move this non-assembled key further to the secret mechanism 201. For such complex and unusual manipulations, it is necessary to use both hands, and these manipulations are not visually controlled, since both the prototype and the analogues propose to install the non-assembled key in the lock from below, placing it under the lock handle. Only the dismountable key 100 can provide the claimed result in simple and familiar ways—the inaccessibility of the secret mechanism 202 of the lock from the outside, thereby providing the inventive step of the group of inventions, which cannot be provided by other methods.

All other methods make it difficult to access the secret mechanism of the lock, but they cannot provide this inaccessibility in simple and familiar ways. In the present group of inventions, the dismountable key 100 is inserted in the keyhole 201, turned by the bow 101, and as a result of this movement, the key secret 103 is separated from the shank 102 and the bow 101. The bow 101 remains in human hands. The docking mechanism 206 prevents accidental or deliberate removal of the bow 101 and/or the shank 102 of the key when the key 100 is disassembled. A person continues to rotate the bow 101, the key secret 103 separately from the bow 101 is moved by the docking mechanism 206 to the secret mechanism 202 completely inaccessible from the outside. Using the locking mechanism 300 with the key 100 and the lock 200 made according to the present group of inventions, the person will not notice any difference compared to using a conventional key and a conventional lock. This method of opening and closing the lock using the dismountable key 100 is no different from the human habitual method of opening the lock with aby conventional non-assembled key. However, the non-assembled key fully inserted in the keyhole 201 in the opposed lock does not have a bow that remains outside the lock during operation and allows the key 100 to be handled in a conventional manner. The bow in the present group of inventions, at the same time, ensures the usual operation of the lock, and ensures that the secret mechanism 202 of the lock is fundamentally inaccessible from the outside. This result is achieved in the claimed feature of the group of inventions without changing the usual human method of opening and closing the lock, precisely by disassembling the key into the parts during the operation of the lock.

The difference between the analogue and the present group of inventions consists in the use of the non-assembled key in the analogue, which does not allow achieving the same result as in the present group of inventions. Therefore, this feature is unobvious from the prior art and involves the inventive step.

The eleventh essential feature of the present group of inventions is the grab 104 known from the prior art, which disassembles the key 100 into parts for easy storage and transportation. In the present group of inventions, this grab 104 is used for a new, hitherto unknown application, i.e. not only for disassembling the key 100 for the purposes of storing and reducing the size of the key 100 and assembling the key 100 before its application (installing it in the lock 200), but also for disassembling and assembling the key 100 when it is in the lock 200.

The industrial applicability of the eleventh feature of the group of inventions follows from the prior art, since there are means that repeatedly disassemble and assemble device parts, for example, a screw and a nut, a collet chuck and a clamped bar. There are mechanical and electrical drives for these devices. It is also possible to use a magnet installed between different steel parts of the key 100, which may disassemble the key 100 and assemble the disassembled parts of the key 100.

The novelty of the eleventh feature of the group of inventions is proved by the conducted patent search and analysis of the prior art, in which there is no information about the installation of the grab 104 between the disassembled parts of the key 100 during the working stroke of the lock.

The result of using the grab 104 installed between the disassembled parts of the key 100 in the present group of inventions is the complete inaccessibility of the secret mechanism 202 of the lock from the outside. The claimed result follows from the impossibility of access of any items to the key secret 103 separated from the rest of the key 100 and to the secret mechanism 202 of the lock, since the grab 104 has separated the key secret 103 from the rest of the key 100.

The inventive step proves that the prototype of the present group of inventions has no grab 104 installed between the parts of the key 100 during the working stroke of the lock. The difference between the prototype and the present group of inventions lies in the fact that access to the secret mechanism is difficult in the prototype, while such access is impossible in the present group of the inventions. It is the difference that does not allow the prototype to achieve the same result as in the present group of inventions. Therefore, this feature is unobvious from the prior art and involves the inventive step.

The twelfth essential feature of the present group of inventions is a hitherto unknown method of using the grab 104 both for the purpose of the known method for disassembling the key into parts when carrying the key, and for the purpose of a hitherto unknown method for using different key secrets 103 with the same remaining parts of the lock 200 (for example, the shank 102 and the bow 101).

The industrial applicability of the twelfth feature of the group of inventions follows from the prior art, since there are means that repeatedly disassemble and assemble device parts, for example, a screw and a nut, a collet chuck and a clamped bar. There are mechanical and electrical drives for these devices. It is also possible to use a magnet installed between different steel parts of the key 100, which can dissemble the key 100 and assemble the disassembled parts of the key 100, as well as attach different key secrets 103 thereto.

The novelty of the twelfth feature of the group of inventions is proved by the conducted patent search and analysis of the prior art, in which there is no information about the installation of the grab 104 between the permanent parts of the key 100, such as the bow 101 and the shank 102, and removable parts of the key 100, such as the key secret 103.

The result of using the grab 104 installed between the parts of the key 100 in the present group of inventions is a reduction in the dimensions and weight of the bunch of the keys 100, since the claimed feature allows transporting and storing only one bow 102 and one lock shank 102 with one grab 104, together with several key secrets 103 for different locks 200. The claimed result follows from the presence of the grab 104 and several removable key secrets 103.

The inventive step proves that the prototype of the present group of inventions does not have several key secrets 103 for different locks 200. The difference between the prototype and the invention lies in the fact that only one key is disassembled in the prototype, while it is possible to use different key secrets 103 with one kit (the bow 101, the shank 102 and the grab 104) in the present group of inventions. It is the difference that does not allow the prototype to achieve the same result as in the present group of inventions. Therefore, the twelfth feature is unobvious from the prior art and involves the inventive step.

The important thirteenth feature of the invention is the stopper 213 known from the prior art, which prevents, in the present group of inventions, the removal of not the entire key 100 but only a part and/or parts of the disassembled key 100 from the keyhole 201 during the disassembled state of the key 100.

The industrial applicability of the thirteenth feature of the group of inventions follows from the prior art, since there are devices that lock any element when it is installed in known devices, for example, a locking screw and a nut, a collet and a clamped bar. There are mechanical and electrical drives for these devices. It is also possible to use a T-shaped circular or linear groove with a slot, which allows one to disconnect a bar inserted into the T-shaped slot with a groove in the form of a T-slot only when this bar is in the slot.

The novelty of the thirteenth feature of the group of inventions is proved by the conducted patent search and analysis of the prior art, in which there is no information about the installation of the stopper 213 securing the disassembled parts of the key 100 during the working stroke of the lock.

The result of using the stopper 213 in the present group of inventions is the complete impossibility of removing the parts of the key 100 from the keyhole 201 when the key 100 is in the disassembled state.

The inventive step proves that the prototype and analogues of the present group of inventions do not have such a stopper 213 which locks the part of the key 100 during the working stroke of the lock 200. The difference between analogues and the present group of inventions lies in the fact that access to the secret mechanism is difficult in the analogues, while such access is impossible in the present group of inventions. It is the difference that does not allow the prototype to achieve the same result as in the present group of inventions. Therefore, the thirteenth feature is unobvious from the prior art and involves the inventive step.

The important fourteenth feature of the invention is the grab 104 known from the prior art, which, in the present group of inventions, unlike the prototype where two parts of the grab 104 are attached to the parts of the key 100, may be completely separated from the remaining parts of the key 100, thereby forming another part of the key 100. This allows the grab 104 to be placed in the keyhole barrier 207 and/or the key barrier 210.

The industrial applicability of this feature of the present group of inventions follows from the prior art, since there are means that repeatedly disassemble and assemble device parts, for example, a screw and a nut, a collet chuck and a clamped bar. There are mechanical and electrical drives for these devices. It is also possible to use a magnet installed between different steel parts of the key 100. By separating from both parts of the key 100, the magnet can dissemble the key 100 and assemble the disassembled parts of the key 100.

The novelty of the fourteenth feature of the group of inventions is proved by the conducted patent search and analysis of the prior art, in which there is no information about the installation of the grab 104 between the disassembled parts of the key 100 during the working stroke of the lock.

The result of using the grab 104 installed between the disassembled parts of the key 100 in the present group of inventions is the inaccessibility of the secret mechanism 202 of the lock from the outside. The stated result follows from the impossibility of any items to access the key secret 103 separated from the rest of the key 100 and to the secret mechanism 202 of the lock, since the grab 104 has separated the key secret 103 from the rest of the key 100.

The inventive step proves that the prototype of the present group of inventions has no grab 104 installed between the parts of the key 100 during the working stroke of the lock. The difference of the analogues and the prototype from the present group of inventions lies in the fact that access to the secret mechanism is difficult in the analogues and the prototype, while such access is impossible in the present group of inventions. It is the difference that does not allow the prototype to achieve the same result as in the present group of inventions. Therefore, the fourteenth feature is unobvious from the prior art and involves the inventive step.

An implementation example of the group of inventions, which comprises several features of the claimed method, includes the key 100 made, entirely or in part, of a material that is attracted to the magnet. The shank 102 of the key 100 has a shaped cross-section, and the key secret 103 of the key 100 also has a certain shaped shape. In the key 100, there is a magnet that performs the role of grab 104. The magnet is attached by magnetic attraction forces on one side to the end of the shank 102, and this magnet is attached by magnetic attraction forces on another side to the end of the key secret 103. Mechanical grabs are also possible.

The lock 200 comprises the lock body 205. An opening 219 is made in the lock body, and a cavity 219-1 is made in the opening 219 on the inner side of the lock body 205. The secret mechanism 202 is placed in this cavity 219-1, and a septum 217 with an axial hole 217-1 and an eccentric shaped hole 217-2 is installed in the opening 219 without the possibility of its movement. This septum 217 may be made integral with the opening 219 or separately from it. The eccentric shaped hole 217-2 in the septum 217 is remote from the secret mechanism 202. The dual cylinder is arranged on both sides of the lock body 205 into the opening 219. This dual cylinder 216 is composed of the shaft 218, the inner coaxial cylinder 216-2 and the outer coaxial cylinder 216-1. The outer coaxial cylinder 216-1 and the inner coaxial cylinder 216-2 are separated by the septum 217. The shaft 218 is placed in the axial hole 217-1 of the septum 217. The coaxial cylinders 216-1 and 216-2 are fixed on the shaft 218 on both sides of the septum 217 without the possibility of their movement relative to the shaft 218. The dual cylinder 216 can rotate together with the shaft 218 in the axial hole 217-1 of the septum 217.

The keyhole 201 is made in the form of a shaped hole located eccentrically relative to the axis of rotation of the dual cylinder 216. The dual cylinder 216 of a pin tumbler lock consists of two coaxial cylinders, the outer cylinder 216-1 and the inner cylinder 216-2, mounted on the common axis 218 of rotation without the possibility of mutual movement. The outer cylinder 216-1 located closer to the outer side of the lock 200 has an eccentric opening of the outer keyhole 201-1, and the inner cylinder 216-2 located farther from the outer side of the lock 200 has an eccentric opening of the inner keyhole 201-2. The cylinders 216-1 and 216-2 having the common axis of rotation are separated by the radially directed fixed septum 217 with the axial hole 217-1 and the eccentric hole 217-2. The axis 218 of rotation of the cylinders 216-1 and 216-2 passes through the axial hole 217-1 in the septum 217. The eccentric hole in the septum 217 in one defined position, in which the lock 200 is in a static position, coincides with the opening of the outer keyhole 201-1 and the inner keyhole 201-2, forming the single keyhole 201. The cylinder 216 acts as the docking mechanism 206 and the keyhole separator 208 as the cylinders are radially separated by the fixed septum 217 with the axial and eccentric holes. This septum acts as the keyhole barrier 207 and the key barrier 210. The septum has a thickness complying with the length of the grab 104 which is made of a magnet. The arrangement of the septum in the axial direction coincides with the arrangement of the magnet when a proper key is inserted. In this position of the cylinder 216, the outer keyhole 201-1 and the inner keyhole 201-2 are connected by the eccentric hole in the fixed septum 217. When the lock cylinder 200 rotates together with the inserted key 100, the magnet that acts as the grab 104 remains in the eccentric hole of the fixed septum 217. The septum serves as the keyhole barrier 207 separating the outer keyhole 201-1 and the inner keyhole 201-2 and as the key barrier 210. The grab 104 made of the magnet is held in the eccentric hole of the septum 217 by the septum-facing ends of the cylinders 216-1 and 216-2. The part of the key 100 with the shank 102 and the bow 101 remains in the outer keyhole 201-1, while the key secret 103 remains in the inner keyhole 201-2. The eccentric hole 217-2 in the septum 217 acts as a cavity for the grab 104. The grab 104 is in this cavity during the working stroke of the lock 200. Further rotation of the cylinder 216, which, together with the fixed septum 217, performs the functions of the docking mechanism 206 and the keyhole separator 208, delivers the key secret 103 to the secret mechanism 202 inaccessible from the outside, where the key secret 103 separated from the rest parts of the key 100 interacts with the secret mechanism 202 of the lock, thereby activating it and opening the lock 200. By rotating about the axis 218, the cylinder 216 acts as the key secret delivery mechanism 212. A stopper cover 220 is mounted on the lock body 205 in front of the outer cylinder 216-1. The stopper cover 220 has a hole made eccentrically and/or with a cutout. This cutout and/or eccentricity allows the key 100 to be inserted and removed only when the lock 200 is in a static position.

This method has advantages in comparison with previously used similar methods, since it completely excludes the possibility of external access to the secret mechanism 202 of the lock 202 the keyhole 201 covered by the fixed septum 217 that acts as the keyhole barrier 207.

The key 100 for such a lock 200 may also be made using a telescopic design, in which, when the key is inserted in the keyhole 201, the key secret 103 is pulled out of the fixed key case 106, and the grab 104 of the key 100 remains in the key case 106, thereby making it possible to simplify the design of the lock 200.

The incomplete list of possible elements of the key 100 and the lock 200 is given below:

Bow 101,
Shank 102,
Stud 102-1,
Key secret 103,
Grab 104,
Tapered shaft 102-1,
Tapered sleeve 103-1,
Key cover 105,
Key case 106,
Keyhole 201,
Outer keyhole 201-1,
Inner keyhole 201-2,
Secret mechanism 202,
Bolt drive 203,
Bolt 204,
Lock body 205,
Docking mechanism 206,
Split collar 206-1 of the docking mechanism,
Split washer 206-2 of the docking mechanism,
Pivot axis 206-3 of the split collar,
Sliding insert 206-4,
Bracket 206-5,
Bracket axis 206-6,
Split collar axis 206-7,
Sliding stud 206-8 of the split washer,
Cylinder 206-9,
Groove 206-91,
Sector 206-92,
Keyhole barrier 207,
Keyhole separator 208,
Lock handle 209,
Key barrier 210, Key barrier mechanism 211,
Key secret delivery mechanism 212,
Stopper 213,
Rocker 214,
Keyhole barrier mechanism 215,
Dual cylinder 216,
Outer coaxial cylinder 216-1,
Inner coaxial cylinder 216-2,
Septum 217,
Central hole 217-1,
Eccentric hole 217-2,
Shaft 218,
Opening 219,
Cavity 219-1,
Cover-stopper 220.

In the present group of inventions, the key 100 and the lock 200 acquire the following new elements unknown from the prior art: the outer keyhole 201-1, the inner keyhole 201-2, the docking mechanism 206, the keyhole barrier 207, the keyhole separator 208, the key barrier 210, the key barrier mechanism 211, the key secret delivery mechanism 212, the keyhole barrier mechanism 215, the dual cylinder 216, the outer coaxial cylinder 216-1, the inner coaxial cylinder 216-2, the septum 217, the central hole 217-1, the eccentric hole 217-2, the shaft 218, the stepped opening 219, the cavity 219-1, the cover-stopper 220.

The present group of inventions will make it possible to replace several keys 100 (from home, work, car, etc.) with several small-sized key secrets 103 for different locks and one key 100 consisting of the bow 101, the shank 102 with the grab 104, as well as to increase the resistance of the lock to opening with lockpicks, bumping and breaking.

Given below is a partial list of the protected features of the present group of inventions, which is grouped in relation to the newly introduced elements of the lock:

A key secret 103 is separated from a key 100:

Device—1). A locking mechanism 300 comprising a key 100 whose key secret 103 can be separated from the rest of the key 100 during the working stroke of the lock 200.

A grab 104 interacts with a docking mechanism 206:

Device—2). The locking mechanism 300, wherein the key 100 comprises at least one grab 104 or another similar mechanism configured to disassemble and assemble parts of the key 100 and installed between any parts of the key 100, wherein the lock comprises at least one docking mechanism 206 or another similar mechanism configured to disassemble the key 100 into parts during the working stroke of the lock 200.

The keyhole 201 is divided into parts:

Device—3). The locking mechanism 300, characterized in that the lock 200 is configured, by using any of the known or unknown methods, as well as any combination of these methods, to disassemble the keyhole(s) 201 into several parts and/or to assemble the keyhole(s) 201 into a single whole from the several parts, the parts of the keyhole 201 comprising an outer keyhole 201-1 and an inner keyhole 201-2.

The parts of key 100 are separated from each other by a key barrier 210:

Device—4) The locking mechanism 300, wherein the disassembled parts of the key 100 during the working stroke of the lock 200 are separated, for a required time, by a key barrier 210 in the form of, for example, a combination of a movable and/or stationary shutter of an arbitrary shape, a movable and/or stationary sector of a circle, another arbitrary movable and/or a fixed geometric shape that does not allow the separated elements of the key 100 to be assembled into a single whole.

The parts of the keyhole 201 are separated by a keyhole barrier 207:

Device—5) The locking mechanism 300, wherein at least one keyhole 201 during the working stroke of the lock 200 is disassembled into parts for a required time by at least one keyhole barrier 207 in the form, for example, of a combination of a movable and/or stationary shutter of arbitrary shape, movable and/or a fixed sector of a circle, another arbitrary movable and/or fixed geometric shape that does not allow the parts of the key 100 to penetrate from one part of the keyhole, for example, from the outer keyhole 201-1 to another part of the keyhole, for example, into the inner keyhole 201-2.

The lock 200 comprises the docking mechanism 206:

Device—6) The locking mechanism 300, wherein the lock 200 comprises, among others, at least one docking mechanism 206 separated from or integrated in the lock 200, and the docking mechanism 206 is isolated or combined with any other elements of the lock 200, driven from any known and/or unknown source of energy, or from a combination of these energy sources, and performs the function of disassembling the key 100 into several parts and/or the function of assembling the key 100 into a single whole from the several parts.

The lock 200 comprises a keyhole separator 208:

Device—7) The locking mechanism 300, wherein the lock 200 comprises, among others, at least one keyhole separator 208 which performs the function of disassembling the keyhole 201 into several parts and/or the function of assembling the keyhole 201 into a single whole from the several parts.

The parts of the key 100 move separately from each other:

Device—8) The locking mechanism 300, wherein some of the parts of the key 100, being inserted into the lock 200 and during the working stroke of the lock, can move separately from the rest of the key 100.

The key secret 103 interacts with a secret mechanism 202 of the lock:

Device—9) The locking mechanism 300, wherein the part of the key 100, which comprises, among others, the key secret 103 and is separated from the rest parts of the key 100, interacts with a secret mechanism 202 of the lock 200.

The lock 200 has a key barrier mechanism 211:

Device—10) The locking mechanism 300, wherein the lock 200 comprises a key barrier mechanism 211 which, during the working stroke of the lock 200, installs at least one key barrier 210 separating the parts of the key 100 from each other.

The delivery of the key secret 103 to the secret mechanism 202 of the lock from a bow 101:

Device—11) The locking mechanism 300, wherein the separated part of the key 100, which comprises the key secret 103, is delivered to the secret mechanism 202 of the lock by some element of the lock 200, including a key secret delivery mechanism 212 driven by a bow 101 of the key 100.

The grab 104 is used to disassemble and assemble the key 100 in the lock 200:

Device—12) The locking mechanism 300, wherein the grab 104 of the key 100 is used to disassemble and assemble the key 100 during the working stroke of the lock 200.

The grab 104 is used to connect different key secrets 103:

Device—13) The locking mechanism 300, wherein the grab 104 of the key 100 is used to connect and/or disconnect different key secrets 103 for different locks 200, while using the same remaining parts of the key 100.

The grab 104 is placed in the keyhole barrier 207 and/or the key barrier 211:

Device—14) The locking mechanism, characterized in that the lock 200 comprises at least one key barrier 210 and/or at least one keyhole barrier 207 that have/has at least one cavity designed/intended to accommodate the grab 104 of the key 100.

The interaction of the parts of the key 100 and the mechanisms of the lock 200:

Method—15) A method, in which, during the working stroke of the lock, the docking mechanism 206 of the lock 200 acts on the grab 104 of the key 100, thereby disassembling the key 100 into parts, the keyhole separator 208 of the lock 200 is used to disassemble the keyhole 201 into a required number of parts, the keyhole barrier 207 is optionally installed into the keyhole 201, the parts of the keyhole 201 are optionally separated from each other by the keyhole barrier 207, the parts of the key 100 are optionally separated from each other by the keyhole barrier 207 and/or the key barrier 210, the bow 101 of the key 100 is left in the outer keyhole 201-1 connected to the external space, while the key secret 103 is placed in the inner keyhole 201-2 separated by the keyhole barrier 207 and/or the key barrier 210, the key secret 103 is captured separately or with any other parts of the key 100, the key secret 103 is moved by any mechanisms of the lock 200 to the secret mechanism 202 of the secret of the lock, the secret mechanism 202 of the lock is made separated from the outer keyhole 201-1, the outer keyhole 201-1 is connected to the key secret delivery mechanism 212 of the lock 200 at a certain position, and the position in which the key secret delivery mechanism 212 is connected to the secret mechanism 202 of the lock is different from the position in which the key secret delivery mechanism 212 is connected to the outer keyhole 201-1 of the lock 200, and the secret mechanism 202 of the lock is activated upon the delivery of the suitable key secret 103 of the key 100.

The key 100 is divided into the parts:

Method—16) The method, in which the key is disassembled into the parts during the working stroke of the lock.

The keyhole 201 is divided into the parts:

Method—17) The method, in which the step of disassembling the keyhole 201 into the parts is performed during the working stroke of the lock 200.

The channel barrier 207 is installed in the keyhole 201:

Method—18) The method, in which, during the working stroke of the lock 200, at least one keyhole barrier 207 separating the parts of the keyhole 201 is placed into the keyhole 201.

The barrier of the key 210 is installed between the parts of the key 100:

Method—19) The method, in which, during the working stroke of the lock 200 and after disassembling the key 100 into the parts, at least one key barrier 210 separating the parts of the key 100 from each other is placed between the parts of the key 100.

The docking mechanism 206 separates the key 100 during the working stroke of the lock 200:

Method—20) The method, in which, during the working stroke of the lock 200, at least one docking mechanism 206 is activated, which/by which the key 100 is disassembled into the parts and/or the key 100 is assembled from the parts of the key 100.

A stopper 213 locks the separated part of the key 100:

Method—21) The method, in which at least one stopper 213 preventing the removal of the part and/or parts of the key 100 from the keyhole 201 is activated during the working stroke of the lock 200

The parts of the key 100 move separately from each other:

Method—22) The method, in which, during the working stroke of the lock 200, the separate movement of the different parts of the key 100 is performed.

The separated key secret 103 of the key 100 activates the secret mechanism 202 of the lock 200:

Method—23) The method, in which, during the working stroke of the lock, the key secret 103 separated from the remaining parts of the key 100 interacts with the secret mechanism 202 of the lock.

The key barriers 210 and the keyhole barriers 207 separate the parts of the key 100:

Method—24) The method, in which the key 100 is disassembled into parts, the keyhole 201 is disassembled into parts, one part of the keyhole 201 is separated from the other part by an barrier/barriers 210 and/or 207, the parts of the key 100 are separated by the same or other barrier/barriers 210 and/or 207, the key secret/secrets 103 of the key 100 separated from the rest of the parts of the key 100 is/are delivered, separately or together with some parts/part of the key 100, to the secret mechanism/mechanisms 202 of the lock.

The bow 101 of key moves the key secret 103 separated from the key 100:

Method—25) The method, in which the key secret/secrets 103 of the key 100 separated from other parts of the key 100 are delivered, separately or together with other part/parts of the key 100, to the secret mechanism/mechanisms 202 of the lock via the action of a human hand on the bow 101 which is connected, if necessary, with the other parts of the key 100.

The grab 104 is used during the working stroke of the lock 200:

Method—26) The method, in which the grab 104 is used to disassemble and/or assemble the key 100 when the key 100 is in the keyhole 201 of the lock 200.

The grab 104 is placed in the keyhole barriers 207 and/or the key barriers 210:

Method—27) The method characterized in that all the following actions are performed in a random sequence: during the working stroke of the lock 200, the key 100 is disassembled into a required number of parts, the grab 104 is fully or partially, with the necessary parts of the key 100 or without them, are placed, together or separately, in the keyhole barrier 207 and/or the key barrier 210.

Different key secrets 103 are attached to the grab 104 of the key:

Method—28) The method, in which different key secrets 103 are attached to the single grab 104 of the key 100 to match different secret mechanisms 202 of locks 200.

The above features constitute the appended set of ten claims. These claims satisfy all three essential patentability requirements and one desirable requirement.

The first mandatory requirement is the need for the completeness of the content of claims, according to which the claims shall include all features necessary and sufficient to obtain a claimed technical result that mediates the solution of a socially significant problem.

The second mandatory requirement is the need for certainty in the content of claims, according to which features included in the content of the claims shall be expressed in generally accepted concepts that do not allow for ambiguous interpretation. For example, in claims, features cannot be characterized by using vague words, such as “long”, “cold”, “strong enough”, etc.

It is not allowed to use negative statements in claims, expressed as the indication of the absence of an element or the absence of a connection between the elements.

The third desirable requirement is a generalization of claims, according to which the content of the claims is characterized by the most general concepts.

The fourth mandatory requirement is a requirement of unity of invention, according to which an independent claim shall comprise features that characterize only one technical solution of a certain technical problem.

The following claims all meet these requirements, which follows from the analysis of the characteristics of the device and the characteristics of the method in the claimed group of inventions:

The analysis of the device features:

The presence of one or more structural elements. Example: the locking device 300 comprises the catch 104, the docking mechanism 206, the keyhole barrier 207;

The presence of interconnection of structural elements. Example: the grab 104 is connected to the key secret 103 and the shank 102, the secret mechanism of the lock 202 is connected to the keyhole 201 only at a certain position;

The mutual arrangement of structural elements. Example: the fixed septum 217 is located between the outer cylinder 206-1 and the inner half-cylinder 217-2;

The form of execution of an element or device as a whole. Example: the eccentric shaped hole 217-2 is shaped like the shank 102 of the key 100.

The geometric shape of an element or device as a whole. Example: the eccentric shaped hole 217-2 is formed in the shape of the grab 104;

The form of execution of interconnection of elements. Example: the inner keyhole 201-2 is associated with the secret mechanism 202 of the lock only during its activation;

Parameters and other characteristics of elements and their relationships. Example: the grab 104 is located in the eccentric shaped hole 217-2;

The material from which an element or device as a whole is made. Example: the grab 104 is made of a magnet;

The environment that serves as an element. Example: the shank 102 is made of steel;

The function performed by an element. Example: the grab 104 disassembles the key 100 into parts;

The function performed by the interconnection of elements. Example: the key secret delivery mechanism 212 connects the secret mechanism 202 of the lock to the keyhole 201.

The analysis of the method features:

The presence of an action or a set of actions. Example: the key 100 is disassembled into parts.

The order of execution of actions in time. Example: the key 100 is disassembled into parts, then the key secret 103 is delivered to the secret mechanism 202 of the lock.

Conditions for performing the actions. Example: the activation of the secret mechanism 202 of the lock is performed upon the delivery of a suitable key secret 103 separated from the shank 102.

What is claimed is:

1. A locking device comprising at least one lock (200) and at least one key (100) inserted in the lock, wherein the lock comprises a lock body (205), a bolt, a keyhole (201) and a secret mechanism (202), wherein the key comprises a bow (101), a shank (102), a key secret (103) and is configured to be disassembled into the key components and assembled from the key components, and wherein the lock comprises a docking mechanism configured to disassemble the key into the key components during a working stroke of the lock when the key is inserted in the lock, and to assemble the key from the key components before the key is removed from the lock.

2. The device of claim 1, wherein the lock comprises:

a keyhole separator configured to separate the keyhole into an outer keyhole connected to an external space and an inner keyhole hidden from the external space; or a keyhole barrier mechanism configured to install at least one keyhole barrier in the keyhole, the keyhole being separated into several keyholes after the keyhole barrier is installed therein; or a key barrier mechanism configured to install at least one key barrier, thereby separating the key components from each other by the key barrier; or a key secret delivery mechanism configured to deliver the key component comprising the key secret to the secret mechanism of the lock, the key component comprising the key secret being separated from the rest key components.

3. A key (100) for a locking device (200), comprising a bow (101), a shank (102), a key secret (103) and a grab (104), wherein the grab is configured to disassemble the key into the key components and assemble the key from the key components, and wherein the key is configured to be disassembled into the key components during a working stroke of a lock after the key is inserted in the lock, and be assembled from the components before the key is removed from the lock.

4. The key of claim 3, wherein the key secret is arranged in a key case and configured to be pulled out of the key case, and wherein the grab is configured to fully or partly remain in the key case when the key is disassembled into the key components.

5. The key of claim 3, wherein a magnetic connection and/or a detachable mechanical connection in the form of a T-slot or a dovetail are/is used to connect the key components.

6. A lock (200) comprising a lock body (205), a bolt, a keyhole (201) and a secret mechanism (202), wherein the lock further comprises a docking mechanism configured to disassemble a key (100) into several components during a working stroke of the lock after the key is inserted in the lock and to assemble the key from the several components before the key is removed from the lock.

7. The lock of claim 6, further comprising:

a keyhole separator configured to separate the keyhole into an outer keyhole connected to an outer space and an inner keyhole hidden from the outer space; or a keyhole barrier mechanism configured to install at least one keyhole barrier in the keyhole, the keyhole being separated into several keyholes after the keyhole barrier is installed therein; or a key barrier mechanism configured to install at least one key barrier, thereby separating the key components from each other by the key barrier; or a key secret delivery mechanism configured to deliver the key component comprising the key secret to the secret mechanism of the lock, the key component comprising the key secret being separated from the rest key components.

8. The lock of claim 7, wherein the lock body has an opening formed therein, and the lock body 205 has a cavity formed on an inner side of the lock body, wherein the secret mechanism of the lock is arranged in the cavity while a septum having an axial hole and an eccentric shaped hole is rigidly mounted in the opening remotely from the secret mechanism, wherein a dual cylinder comprising a shaft, an inner coaxial cylinder and an outer coaxial cylinder is arranged in the opening, the outer coaxial cylinder and the inner coaxial cylinder being separated by the septum, the shaft being arranged in the axial hole of the septum, the coaxial cylinders being fixed on the shaft from both sides of the septum without the possibility of their movement relative to the shaft, and wherein the dual cylinder is configured to rotate together with the shaft in the central hole of the septum.

9. A method for operating a locking device, wherein the locking device comprises:

a lock (200) comprising a lock body (205), a bolt, a keyhole (201), a secret mechanism (202), and a docking mechanism, and a key (100) comprising a bow (101), a shank (102), a key secret (103) and a grab (104), wherein the method comprises:

inserting the key in the keyhole, moving and/or rotating the bow in a required direction, opening the lock if the key secret matches the secret mechanism of the lock, closing the lock in reverse order, wherein the docking mechanism is used to disassemble the key into the components during a working stroke of the lock after the key is inserted in the lock, and to assemble the key into a single whole from the components before the key is removed from the lock.

10. The method of claim 9, further comprising:

disassembling the keyhole into parts when disassembling the key into the components, and separating the parts of the keyhole from each other by using keyhole barriers.

* * * * *